US009770120B2

(12) United States Patent
Benezri

(10) Patent No.: US 9,770,120 B2
(45) Date of Patent: Sep. 26, 2017

(54) PORTABLE LOUNGE

(71) Applicant: Pazit Benezri, Irvine, CA (US)

(72) Inventor: Pazit Benezri, Irvine, CA (US)

( * ) Notice: Subject to any disclaimer, the term of this patent is extended or adjusted under 35 U.S.C. 154(b) by 0 days.

(21) Appl. No.: 14/713,434

(22) Filed: May 15, 2015

(65) Prior Publication Data

US 2016/0088953 A1 Mar. 31, 2016

Related U.S. Application Data

(63) Continuation-in-part of application No. 29/503,524, filed on Sep. 26, 2014, now Pat. No. Des. 755,535.

(60) Provisional application No. 62/131,127, filed on Mar. 10, 2015.

(51) Int. Cl.

| | |
|---|---|
| ***A45F 4/02*** | (2006.01) |
| ***A47D 13/06*** | (2006.01) |
| ***A45F 4/00*** | (2006.01) |
| ***A45F 4/06*** | (2006.01) |
| ***A47G 9/06*** | (2006.01) |
| ***A45F 3/04*** | (2006.01) |
| ***A63H 33/00*** | (2006.01) |
| ***A63H 3/00*** | (2006.01) |

(52) U.S. Cl.

CPC ..... *A47D 13/063* (2013.01); *A45F 3/04* (2013.01); *A45F 4/00* (2013.01); *A45F 4/06* (2013.01); *A47G 9/062* (2013.01); *A63H 3/003* (2013.01); *A63H 3/005* (2013.01); *A63H 33/006* (2013.01); *A63H 33/008* (2013.01)

(58) Field of Classification Search

CPC .... A47D 13/061; A47D 13/063; A47D 13/06; A47D 7/00; A47D 7/002; A47D 9/00; A47D 9/005; A47D 11/00; A63H 33/006; A63H 33/008; A45F 4/00; A45F 4/02; A45F 4/06; A45F 2004/026; A45F 4/08; A47G 9/062

USPC ..... 5/99.1, 93.1–93.2, 102, 655; D6/390–391; 135/126, 128; 224/155–156

See application file for complete search history.

(56) References Cited

U.S. PATENT DOCUMENTS 2,691,177 A 10/1954 Leonard
2,992,440 A * 7/1961 Revolt ..... A47D 13/06 217/42
3,018,493 A 1/1962 Wittbrodt
(Continued)

FOREIGN PATENT DOCUMENTS

WO WO974391 11/1997

*Primary Examiner* — Scott McNurlen
(74) *Attorney, Agent, or Firm* — Rimas Lukas

(57) ABSTRACT

A plush children's lounge is provided. The lounge includes a sidewall connected to a base. The lounge is convertible between an open configuration and a closed configuration and a fastener is provided. When the fastener is connected, the lounge defines a closed configuration having a reduced length and suitable for portability. Backpack straps are provided so that the lounge can be carried on the back. The sidewall is resilient such that the lounge springs into the open configuration when the fastener is released. When in the open configuration, a child can recline inside the lounge. Scallops in the sidewall serve as a headrest for the lounger and a plush toy head with eyes is connected to the lounge such that the child can see the plush toy while lying in the lounge. The lounge further includes arms and legs that resemble an animal or other creature.

11 Claims, 15 Drawing Sheets

(56) References Cited

U.S. PATENT DOCUMENTS

| | | | | |
|---|---|---|---|---|
| 4,561,138 | A | 12/1985 | Hwang | |
| 4,698,862 | A | 10/1987 | Mairs | |
| 5,088,139 | A * | 2/1992 | Bloom | A47D 13/063 190/1 |
| D330,139 | S | 10/1992 | Bloom | |
| D347,329 | S * | 5/1994 | Wilkins | D21/808 |
| D366,368 | S | 1/1996 | McCarthy | |
| 5,987,665 | A | 11/1999 | Simontob et al. | |
| 6,062,446 | A | 5/2000 | Daneau | |
| 6,199,230 | B1 * | 3/2001 | Parikh | A47D 13/063 5/420 |
| 6,343,968 | B1 | 2/2002 | Louie et al. | |
| 6,389,624 | B1 | 5/2002 | Madole | |
| 6,505,366 | B1 * | 1/2003 | Lied | A47D 15/003 5/425 |
| 6,687,928 | B1 | 2/2004 | Wilson | |
| 6,694,994 | B1 | 2/2004 | Zheng | |
| 6,851,136 | B2 | 2/2005 | Brereton | |
| 6,886,195 | B2 | 5/2005 | Rimbau Vidal | |
| 6,901,940 | B2 | 6/2005 | Zheng | |
| 6,907,626 | B1 | 6/2005 | Welsh, Jr. et al. | |
| D508,181 | S | 8/2005 | Welch | |
| 7,284,289 | B1 | 10/2007 | Biagini | |
| 7,308,989 | B2 | 12/2007 | Zheng | |
| 7,520,010 | B2 | 4/2009 | Welch | |
| RE40,754 | E | 6/2009 | Morton | |
| 7,699,186 | B2 | 4/2010 | Zheng | |
| 7,739,759 | B2 | 6/2010 | Mendes et al. | |
| 7,743,442 | B2 * | 6/2010 | Maloney | A47C 21/08 446/72 |
| 8,141,186 | B2 | 3/2012 | Burns et al. | |
| 8,201,291 | B2 | 6/2012 | Burns et al. | |
| D755,535 | S * | 5/2016 | Benezri | D6/391 |
| 2005/0028277 | A1 | 2/2005 | Gordon et al. | |
| 2006/0117478 | A1 | 6/2006 | Cheung | |
| 2007/0122066 | A1 | 5/2007 | Landay | |
| 2007/0289060 | A1 * | 12/2007 | Berkey | A47C 21/046 5/99.1 |

* cited by examiner

PORTABLE LOUNGE

CROSS-REFERENCE TO RELATED APPLICATIONS

This application is a continuation-in-part of U.S. patent application Ser. No. 29/503,524 entitled "Foldable baby bed" filed on Sep. 26, 2014 which is incorporated herein by reference in its entirety and this application claims priority to and benefit of U.S. Provisional Patent Application Ser. No. 62/131,127 entitled "Portable lounge" filed on Mar. 10, 2015 which is incorporated herein by reference in its entirety.

FIELD OF THE INVENTION

This application relates generally to children's objects, toys and playthings, and in particular, to children's portable lounge.

BACKGROUND OF THE INVENTION

Sometimes baby pads come in handy when needing to change an infant's diaper. Typically, these pads spread open to provide a clean changing surface for the infant to lie on. Changing pads include various pockets that are integral with the changing pad. The pockets on the changing pad make wipes, diapers, lotions, powders or other items readily accessible. After use, these pads are rolled back up and placed inside a larger baby bag that is carried by an adult. Changing pads are generally not used as a sleeping surface, as they are not made for that purpose and may be too thin and unable to contain a sleeping infant or provide a cozy environment. Therefore, when traveling, a parent may also bring along other articles, such as a stroller or bassinet, to provide a sleeping location for a child on the go. Although strollers/bassinets are comfortable and convenient, they are also large and cumbersome at times. Infant beds and play pens are not easily portable but are also sometimes taken along. Portable infant beds are cumbersome to carry everywhere especially with all the other articles. It is challenging for an adult to carry many items when on the go. Also, certain beds are heavy and not easily portable. An adult on the go would like to be able to have their hands available for the child and also have a convenient and easy place to lay the child down. However, it may be difficult to find a suitable and clean location for the child to lay down that makes the adult and child both feel safe, comfortable and connected.

Furthermore, babies are known to feel more calm and safe when they are in familiar environments and have favorite objects with them when at home or away. Also, children often enjoy cuddling and carrying a soft toy, pillow or blanket for comfort. As such, children may become emotionally attached to a particular plush toy and typically enjoy having their favorite plush toy with them before they go to sleep for a nap or at night or to bring to a friend's house or any other location. Such an emotional attachment to a plush toy or blanket may result in an adult transporting the object everywhere the child goes in addition to other objects such as a portable bed or stroller. Therefore, there is a need for a lounge that is enjoyable for an infant, provides a safe place for play or sleep, is lightweight and easily portable and that makes life easier for the adult without necessitating carrying numerous bulky items. The present invention provides a light portable lounge that works to unite and merge these goals in a unique way.

SUMMARY OF THE INVENTION

According to one aspect of the invention, a portable plush children's lounge is provided. The lounge includes a base made of flexible cushion material. The base has a top surface and a bottom surface defining a thickness therebetween. The base has a longitudinal axis and a lateral axis that is perpendicular to the longitudinal axis and a vertical axis that is perpendicular to the plane containing the longitudinal axis and the lateral axis. The base has a length along a longitudinal axis and a width along a lateral axis. The top surface and the bottom surface are substantially parallel to a plane containing the longitudinal axis and the lateral axis. The lounge further includes a sidewall connected to the base such that the sidewall encompasses the base to define an interior of the lounge. The sidewall extends from the top surface of the base upwardly along the vertical axis. The sidewall is made of flexible material and has a top end and a bottom end defining a height. The sidewall has an outer surface and an inner surface defining a thickness therebetween. The outer surface of the sidewall defines an outer perimeter of the lounge. The lounge further includes a fastener connected to the outer surface of the sidewall. The fastener includes a first part and second part. The first part of the fastener is releasably connectable to the second part. The first part is connected to the second part when locked and the first part is disconnected from the second part when unlocked. The lounge includes an open configuration in which the fastener is unlocked and a closed configuration in which the fastener is locked. When in the closed configuration, the sidewall defines a symmetric inverted upside-down U-shape when the lounge is viewed from above along the vertical axis and the fastener bridges and closes the opening of the U-shape.

According to another aspect of the invention, a lounge is provided. The lounge includes a base made of flexible material and having a top surface and a bottom surface defining a thickness therebetween. The base has a longitudinal axis and a lateral axis that is perpendicular to the longitudinal axis and a vertical axis that is perpendicular to the plane containing the longitudinal axis and the lateral axis. The base has a length along a longitudinal axis and a width along a lateral axis. The length of the base is longer than the width. The top surface and the bottom surface are substantially parallel to a plane containing the longitudinal axis and the lateral axis. The lounge further includes a sidewall connected to the base such that the sidewall encompasses the base to define an interior of the lounge. The sidewall extends from the top surface of the base upwardly along the vertical axis. The sidewall is made of flexible material and has a top end and a bottom end defining a height. The sidewall has an outer surface and an inner surface defining a thickness therebetween. The outer surface of the sidewall defines an outer perimeter. The sidewall includes at least one scallop that curves toward the base and has a lower height relative to the height of the adjacent sidewall. The at least one scallop is located along the longitudinal axis. The lounge also includes a plush toy head connected to the sidewall along the lateral axis and such that the head extends along the vertical axis a distance above the top end of the sidewall. The head has a face that faces the interior of the lounge.

According to another aspect of the invention, a lounge is provided. The lounge includes a base and a sidewall connected to the base such that the sidewall encompasses the base to define an interior of the lounge. The interior of the lounge is sized and configured to receive a child. The sidewall extends from the top surface of the base upwardly along a vertical axis defining a height. The sidewall has an outer surface and an inner surface defining a thickness therebetween. The lounge includes a plush toy head, two arms and two legs connected to the sidewall and extending outwardly from the sidewall. The base, sidewall, toy head, two arms and two legs are configured to mimic a body of a creature when in an open configuration and also when in a closed configuration when viewed from the same orientation. The closed configuration reduces a length of the mimicked body while the arms, legs and head remain in the same orientation. The open configuration is adapted to receive a child in the interior of the lounge and the closed configuration is adapted for portability.

According to another aspect of the invention, a lounge is provided. The lounge includes a base made of flexible material and having a top surface and a bottom surface defining a thickness therebetween. The base has a longitudinal axis and a lateral axis that is perpendicular to the longitudinal axis and a vertical axis that is perpendicular to the plane containing the longitudinal axis and the lateral axis. The base has a length along a longitudinal axis and a width along a lateral axis. The length of the base is longer than the width. The top surface and the bottom surface are substantially parallel to a plane containing the longitudinal axis and the lateral axis. The lounge also includes a sidewall connected to the base such that the sidewall encompasses the base to define an interior of the lounge. The sidewall extends from the top surface of the base upwardly along the vertical axis. The sidewall is made of flexible material and has a top end and a bottom end defining a height. The sidewall has an outer surface and an inner surface defining a thickness therebetween. The outer surface of the sidewall defines an outer perimeter. The sidewall includes at least one scallop that the curves toward the base and has a lower height relative to the height of the adjacent sidewall. The lounge further includes a plush toy head connected to the sidewall along the lateral axis and such that the head extends along the vertical axis a distance above the top end of the sidewall. The head has a lateral dimension that extends along the lateral axis and a longitudinal dimension that extends along the longitudinal axis. The lateral dimension of the head extends toward the interior past the inner surface of the sidewall. The head has a face that faces the interior of the lounge. The lounge further includes at least a first limb and a second limb connected to the sidewall on a first side of the longitudinal axis. Each of the first limb and second limb is substantially oppositely located from each other across the lateral axis. A third limb and a fourth limb is connected to the sidewall on a second side of the longitudinal axis opposite from the first side. Each of the first limb and second limb is substantially oppositely located from each other across the lateral axis. The lounge includes a fastener connected to the outer surface of the sidewall. The fastener comprises a first part and second part. The first part is releasably connectable to the second part. The first part is connected to the second part when locked. The first part is disconnected from the second part when unlocked. The first part and the second part are located along the outer surface of the sidewall between the first limb and the second limb. The lounge includes at least one strap configured such that the lounge can be carried as a backpack with the bottom surface of the base facing the users back. The lounge includes an open configuration in which the fastener is unlocked and the length of the lounge along the longitudinal axis is longer than the width of the lounge along the lateral axis. The lounge includes a closed configuration in which the fastener is locked and the length of the lounge is shorter than the length of the lounge in the open configuration. When in the closed configuration, the sidewall defines an inverted U-shape when viewed from above along the vertical axis and the fastener bridges the opening of the U-shape in the sidewall.

According to another aspect of the invention, a plush children's lounge is provided. The lounge includes a sidewall connected to a base. The lounge is convertible between an open configuration and a closed configuration and a fastener is provided. When the fastener is connected, the lounge defines a closed configuration having a reduced length suitable for portability. Backpack straps are provided so that the lounge can be carried on the back. The sidewall is resilient such that the lounge springs into the open configuration when the fastener is released. The lounge springs open and expands along the longitudinal and lateral lengths to assume its relaxed elongate configuration. When in the open configuration, a child can recline inside the lounge. Scallops in the sidewall serve as a headrest for the lounger and a plush toy head with eyes is connected to the lounge such that the child can see the plush toy when laying in the lounge. The lounge further includes arms and legs that resemble an animal or other creature.

According to another aspect of the invention, a baby lounge in provided. The lounge includes a cover or sleeve or jacket having an opening and a foam wall removably insertable into the cover through the opening. The wall is concealed inside the cover and the opening is closable to contain the wall in an interior space of the cover. The foam wall is cylindrical in shape having a central lumen and the cover includes a padded base that extends across the central lumen. The cover is placed over the wall and the opening is zipped closed around the perimeter of the base. The foam and cover together define a container for an infant. The foam wall further includes an inner surface and an outer surface interconnected by a top and a bottom. The inner surface and the outer surface define a wall thickness. The wall includes a plurality of holes formed in the foam wall such that the holes extend between the outer surface and the inner surface to make the wall breathable. In one variation, the holes are located near the bottom of the wall. The cover includes an inner layer configured to cover the inner surface of the foam wall and an outer layer configured to cover the outer surface of the foam wall. The inner layer has an inner mesh portion configured to be adjacent to the plurality of holes and the outer layer having an outer mesh portion configured to be adjacent to the plurality of holes to provide ventilation across the foam wall and cover and into the interior of the baby lounge.

According to another aspect of the invention, a soother is provided. The soother is a device configured to transmit light, sound or vibration. The device includes a first hook. The first hook has a downwardly facing U-shape. The first hook is configured to slide over a vertical sidewall of a baby lounge receiving the vertical sidewall of the baby lounge inside the U-shape to secure the device onto the sidewall in a vertical direction. The device includes a second hook located on the side of the first hook. The second hook comprises a cutout on the side of the first hook. The second hook is configured to engage a loop located on the vertical sidewall to secure the device in a lateral direction on the sidewall.

According to another aspect of the invention, a method of converting a baby lounge is provided. The method includes providing a baby lounge having a resilient and flexible sidewall defining an elongate cylindrical shape when in an open configuration. The lounge has a fastener comprising a first part spaced from a second part located along an outer surface of the sidewall. The first part of the fastener is configured to releasably connect to the second part. The lounge has an open configuration for a lounger and a closed configuration for portability. The method includes the step of moving a portion of the sidewall that is located between the first part and the second part laterally toward an opposite sidewall to move the first part and second part together. The method includes the step of moving the sidewall and the first part and second part closer together to create a U-shape in the sidewall in the same plane when viewed from above. The method includes the step of bridging the open end of the U-shape with the fastener. The method includes the step of connecting the first part and the second part of the fastener together. The method includes the step of releasing the fastener to convert from a closed configuration to an open configuration. The method includes the step of allowing the resilient sidewall to self-expand from a closed configuration to an open configuration when the fastener is released.

DETAILED DESCRIPTION OF THE INVENTION

Figure 1:
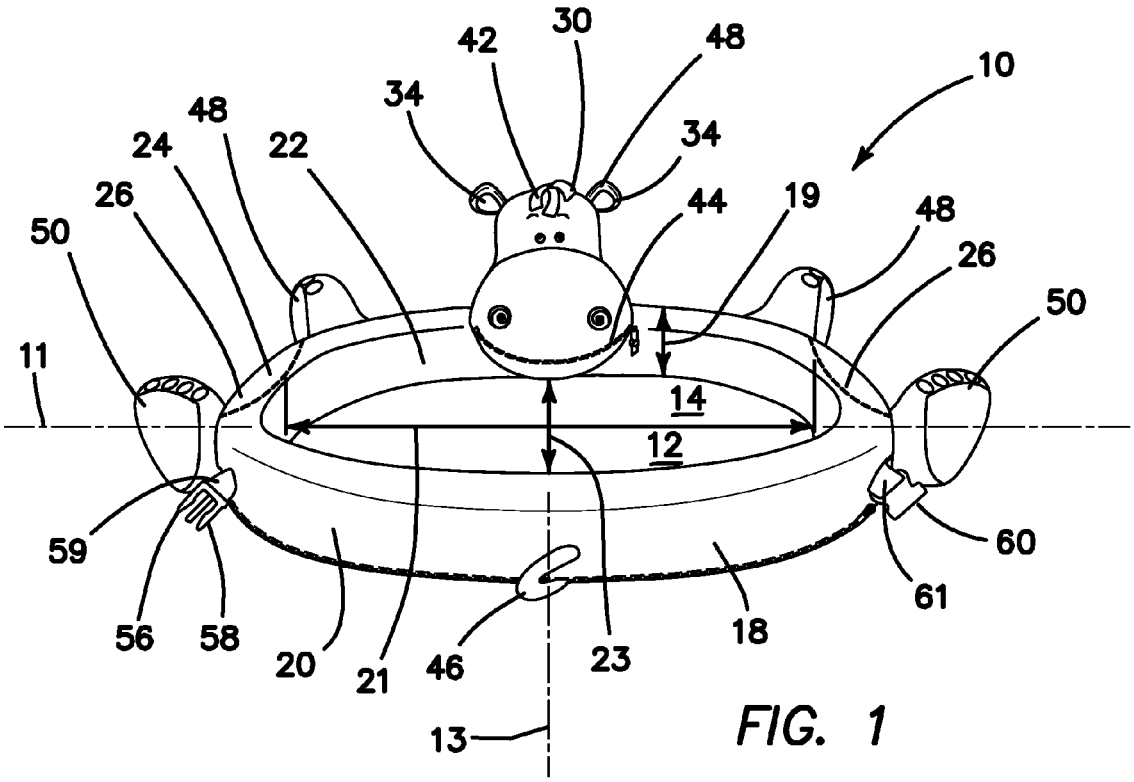
FIG. 1 is a top perspective view of a lounge in an open configuration according to the present invention.

Turning now to the figures, there is shown a lounge 10 according to the present invention. The lounge 10 includes a base 12 interconnected to a sidewall 18. The base 12 has a top surface 14 and a bottom surface 16. The top surface 14 and the bottom surface 16 of the base 12 are substantially planar and parallel surfaces and define a thickness therebetween. A vertical axis 15 extends substantially perpendicularly to the top surface 14 and bottom surface 16. The base 12 further includes a longitudinal axis 11 that is perpendicular to the vertical axis 15 that is perpendicular to a lateral axis 13. The base 12 is made of plush, soft material such as foam or the like that provides cushioning and support for an infant, young human, adult or pet such as a cat, dog or other animal. The base 12 has a length 21 that is longer than its width 23 when viewed along the vertical axis 15. The longitudinal axis 11 runs along the length 21 of the base 12 and a lateral axis 13 runs along its width 23. The base 12 has an elongate or oval shape having a smooth perimeter. In another variation, the base 12 is polygonal, square-shaped, rectangular, circular or any shape having a smooth or angled perimeter.

Figure 6:
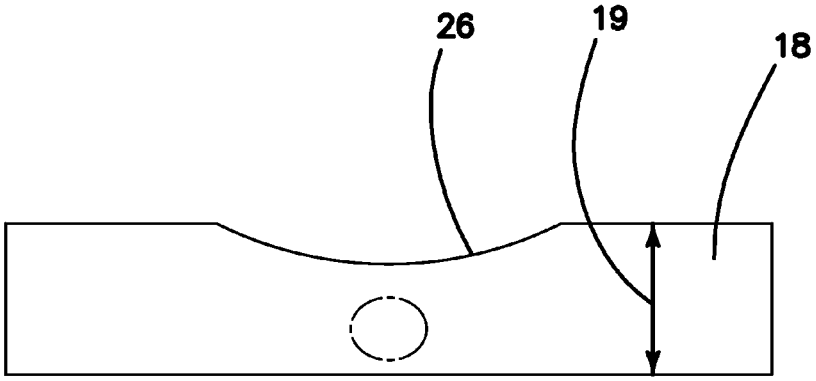
FIG. 6 is a sectional side view of a sidewall with a scallop according to the present invention.

The sidewall 18 is connected to the base 12. In one variation, the sidewall 18 is connected to the base 12 along the perimeter of the base 12. The sidewall 18 is connected to the base 12 such that the sidewall 18 extends vertically upwardly from the base 18 along the vertical axis 15 to define an interior space of the lounge 10. The sidewall 18 encompasses the base 12 and has a height 19. The height 19 of the sidewall 18 is approximately 5 inches. The sidewall 18 includes an outer surface 20 that faces outwardly and an inner surface 22 that faces toward the interior space of the lounge 10. Together the outer surface 20 and the inner surface 22 define a thickness of the sidewall 18 of the lounge 10. The sidewall 18 includes a top end 24 that may be flat, tapered or curved. The sidewall 18 is made of plush, soft and safe material such as foam or the like and provides cushioning and support. The sidewall 18 includes at least one scallop 26 along the sidewall 18. The scallop 26 is a location along the sidewall 18 where the sidewall 18 has a reduced height 19. Turning briefly now to FIG. 6, there is shown the detail of a scallop 26 in the sidewall 18. The scallop 26 includes a top end 24 of the sidewall 18 that is concave. The top end 24 is curved downwardly in the location of the scallop 26 such that the height 19 of the sidewall 18 is reduced along the vertical axis 15. For example, the lowest height 19 of the scallop 26 is approximately 3 inches compared to an overall height 19 of the sidewall 18 of approximately 5 inches. The height 19 of the scallop 26 is reduced by approximately 2 inches in the location of the scallop 26. The top end 24 of the sidewall 18 smoothly transitions in the location of the scallop 26. In one variation, one scallop 26 is located along the longitudinal axis 11 of the lounge 10. In another variation, two scallops 26 are provided. In one variation, the two scallops 26 are located oppositely from each other. In another variation, the two scallops 26 are located along the longitudinal axis 11. The scallop 26 provides a head-receiving portion for the infant, human or animal to relax and rest the back of the head, for example, such that the head is comfortably and slightly raised when using the lounge 10.

The lounge 10 further includes a plurality of entertainment features 28 connected to the base 10 and/or sidewall 18. The entertainment features includes one or more of a head, face, eyes, ears, nose, mouth, hair, limb, arm, leg, tail, foot and hand. In one variation of the lounge 10, the entertainment features 28 pertain to a particular animal. In another variation, the entertainment features 28 are made to resemble a human, non-human, or make-believe creature or cartoon-character. The entertainment features 28 are constructed of the same material as the sidewall 18 and base 12 giving the entire lounge 10 the same look and feel.

Figure 7:
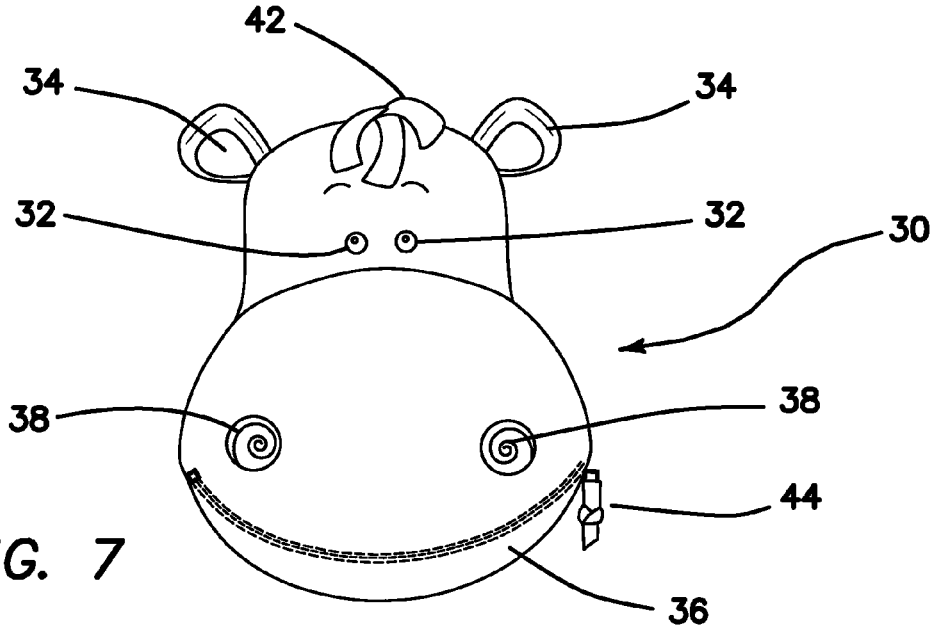
FIG. 7 is a front view of a head having a zippered mouth according to the present invention.

In the variation of the lounge 10 shown in FIGS. 1-5, the lounge 10 includes a head 30 connected to the sidewall 18. With additional reference to FIG. 7, the head 30 resembles an animal such as hippopotamus. The head 30 includes a face having two eyes 32, ears 34, a mouth 36, nose/nostrils 38, horns 40 and hair 42. The head 30 is connected to the sidewall 18 such that the face including two eyes 32 face generally in the direction of the interior space of the base 12. In particular, the head 30 is attached to the sidewall 18 such that a child laying in the lounge 10 with his/her head situated in a sidewall scallop 26 can see the head 30 and the face of the head 30. In one variation, the head 30 is attached along the top circumference of the sidewall 18, that is, that portion of the sidewall 18 that is located above the longitudinal axis 11. In another variation, the head 30 is attached at a location above the longitudinal axis 11 and aligned along the lateral axis 13. Generally, the head 30 extends upwardly along the vertical axis 15 above the sidewall 18. In one variation of the head 30, a pocket is provided within the head 30. In one variation, the pocket is closed with a fastener such as a zipper 44 aligned with and in the location of or integrally formed with the mouth 36 of the head 30. The pocket is accessed by unzipping the mouth 36 wherein small items such as toys or little blankets may be stowed. The zipper 44 is configured to extend along the entire length of the mouth 36. Other pockets may be formed inside the head 30 in the location of the ears 34 or nose 38 of head 30. Fasteners other than zippers, such as buttons, hook-and-loop type fasteners may be employed at the pocket openings. In another variation, no fastener is employed to close off the pocket. The head 30 may or may not include a neck portion located between the head 30 and the sidewall 18. The head 30 is a plush toy that resembles a creature such as an animal (e.g. a dog, elephant, rabbit, giraffe, monkey, frog, etc.) or a person, or a fictional creature such as a mythical creature or alien. The head 30 is soft and may be stuffed and is sewn, glued or stitched to the sidewall 18.

Still referencing FIGS. 1-5, the lounge 10 further includes a tail 46 connected to the lounge 10. In one variation, the tail 46 is connected to the sidewall 18 and, in particular, to the outer surface 20 of the sidewall 18. The tail 46 may also be connected to bottom surface 16 of the base 12. The tail 46 is approximately 4 inches long and approximately 1 inch wide and may be longer or shorter depending upon the type of animal being depicted. For example, if a monkey is being depicted, the tail 46 may be longer. Furthermore, the shape, features and style of the tail 46, just like those of the head 30, correspond to the type of animal or character being depicted. A pig tail may be corkscrew in shape and a horsetail may include hair. Or, of course, no tail 46 may be included. Generally, if a tail 46 is included, it is located along the sidewall 18 at a location below the longitudinal axis 11. In another variation, the tail 46 is located along the sidewall 18 at a location below the longitudinal axis 11 and aligned along the lateral axis 13 such that the tail 46 is located substantially opposite from the head 30.

Still referencing FIGS. 1-5, the lounge 10 further includes two appendages that resemble arms 48 of the creature. The arms 48 are connected to the sidewall 18. In particular, the arms 48 are connected along the perimeter of the sidewall 18 that is located at or above the longitudinal axis 11 with the head 30 located between the two arms 48. The arms 48 are located on either side of the head 30. Each arm 48 is configured to correspond to the animal or character being depicted and as such may or may not include a hand with fingers, a paw, or pad located at the distal end of the limb. The arms 48 are preferably connected to the outer surface 20 of the sidewall 18 and extend outwardly from the sidewall 18.

Still referencing FIGS. 1-5, the lounge 10 further includes two additional appendages that resemble two legs 50 of the creature. The legs 50 are connected to the sidewall 18. In particular, the legs 50 are connected along the perimeter of the sidewall 18 that is located at or below the longitudinal axis 11 with the tail 46, if one is included, located between the two legs 50. The legs 50 are located on either side of the tail 46. Each leg 50 is configured to correspond to the animal or character being mimicked and as such may or may not include toes, pad, nails and the like located at the distal end of the limb. The legs 50 are preferably connected to the outer surface 20 of the sidewall 18 and extend outwardly from the sidewall 18. The arms 48, legs 50, head 30 and tail 46 may include filling to give the entertainment features 28 a more voluminous look and feel.

In one variation, a removable a slip cover 52 is provided which is sized and configured to cover the base 12 and sidewall 18. A zipper 54 is provided in the slip cover 52 to make it easily removable for cleaning in the laundry. In one variation, the zipper 54 is located along the lower perimeter of the sidewall 18 such that it is obscured from view. The zipper 54 is also curved to match the perimeter of at least a portion of the perimeter located below the longitudinal axis 11. The zipper 54 preferably extends along the sidewall 18 between the two legs 50. In one variation, the removable slip cover 52 includes openings for the tail 46, arms 48, legs 50 and head 30 to extend through. The slip cover 52 is made of a soft, plush and washable fabric material having a color and/or pattern that corresponds to the character or animal being mimicked.

Furthermore, the lounge 10 includes a fastener 56 connected to the sidewall 18. The fastener 56 includes a first part 58 and a second part 60 configured to connect together and to be released. The fastener 56 may be a buckle as shown in the figures, although any type of fastener 56 can be employed such as a hook-and-loop type fastener, button, or belt. The first part 58 and the second part 60 of the fastener 56 are connected to the outer surface 20 of the sidewall 18 approximately midway between the top end and the bottom end of the sidewall 18. In one variation, the first part 58 is spaced apart from the second part 60 of fastener 56 by a distance along the perimeter of the sidewall 18 of approximately twice the distance of the width of the base 12 along the lateral axis 13. In one variation, the fastener 56 further includes a first strap 59 having an inner surface and an outer surface. The first strap 59 is connected to the first part 58. The fastener 56 further includes a second strap 61 having an inner surface and an outer surface. The second strap is connected to the second part 60. The first and second straps 59, 61 give the user some leeway when manipulating the first and second parts 58, 60 of the fastener 56.

Figure 2:
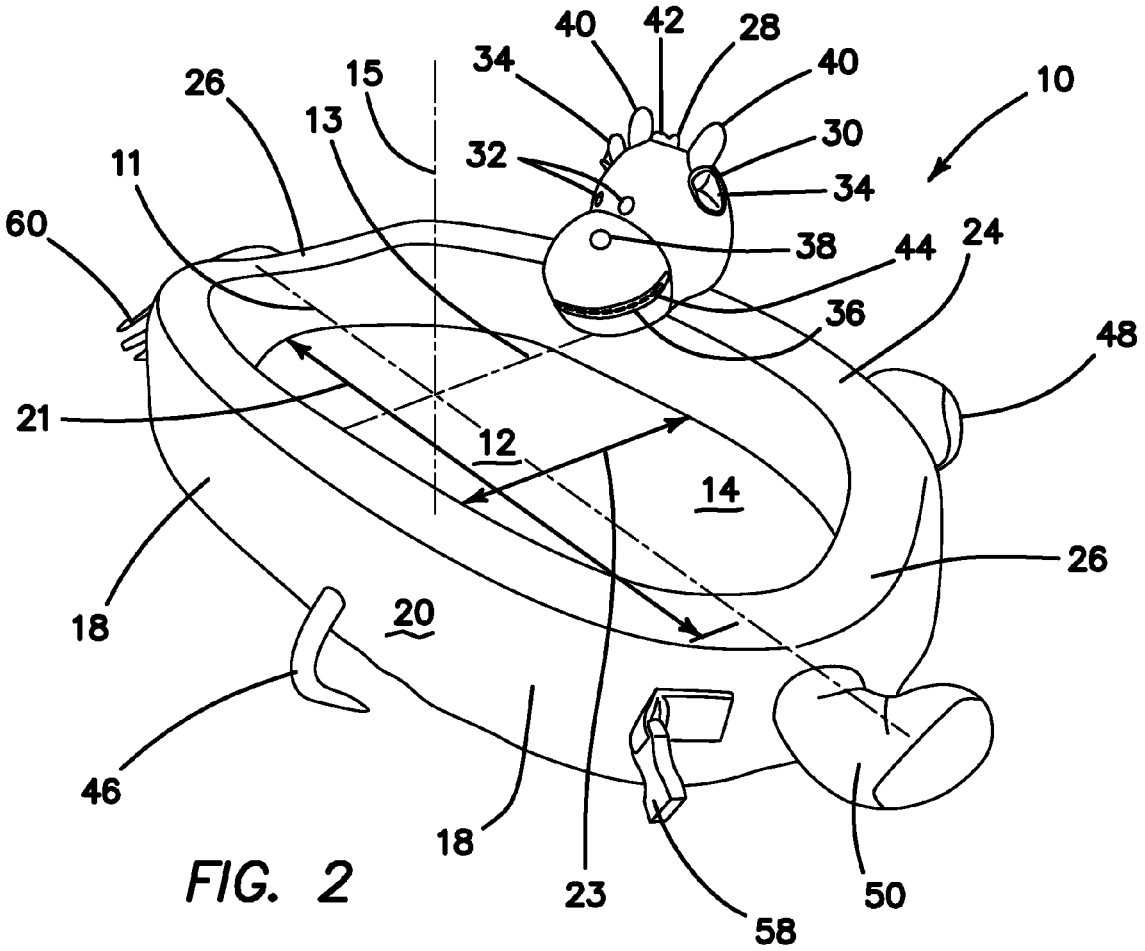
FIG. 2 is a top perspective view of a lounge in an open configuration according to the present invention.
Figure 3:
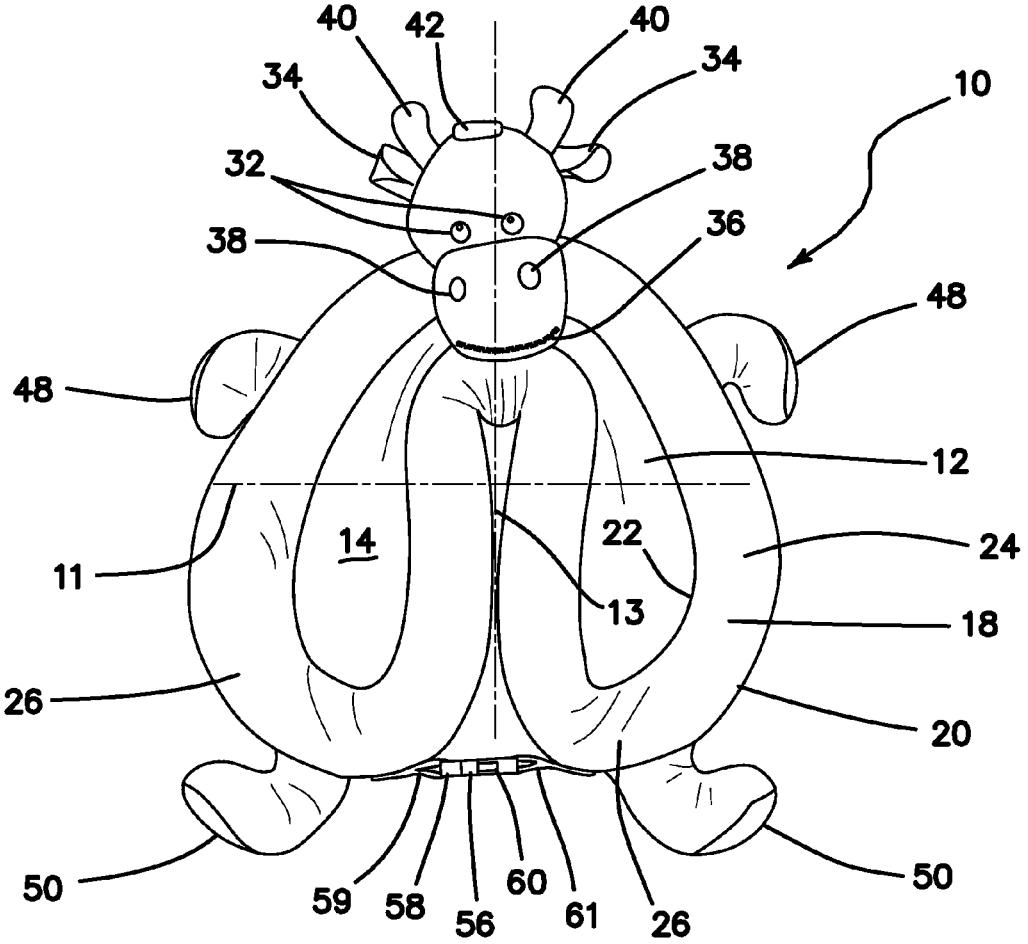
FIG. 3 is a top view of a lounge in a closed configuration according to the present invention.
Figure 4:
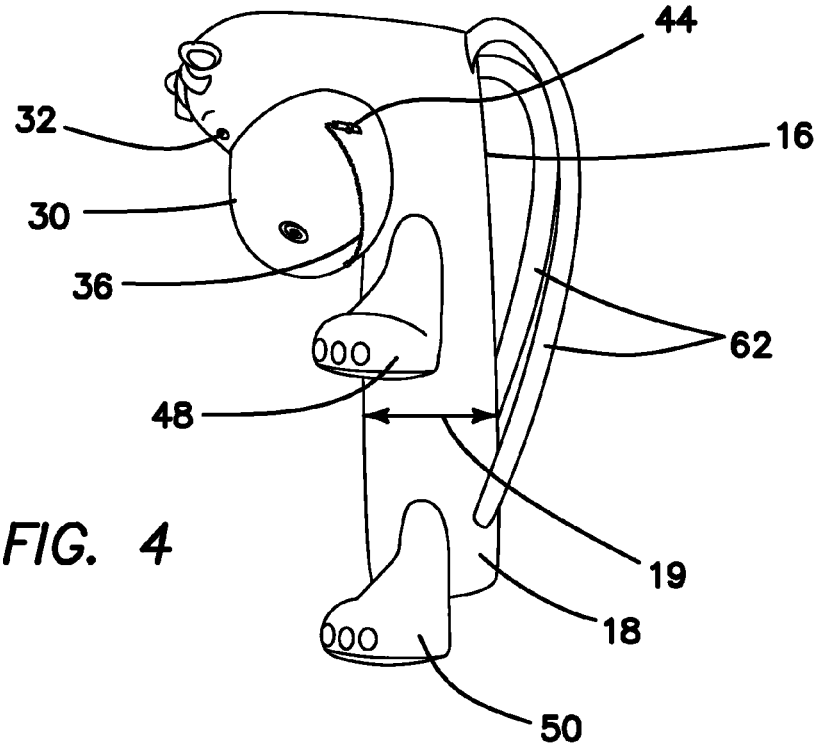
FIG. 4 is a side view of a lounge in a closed configuration according to the present invention.
Figure 5:
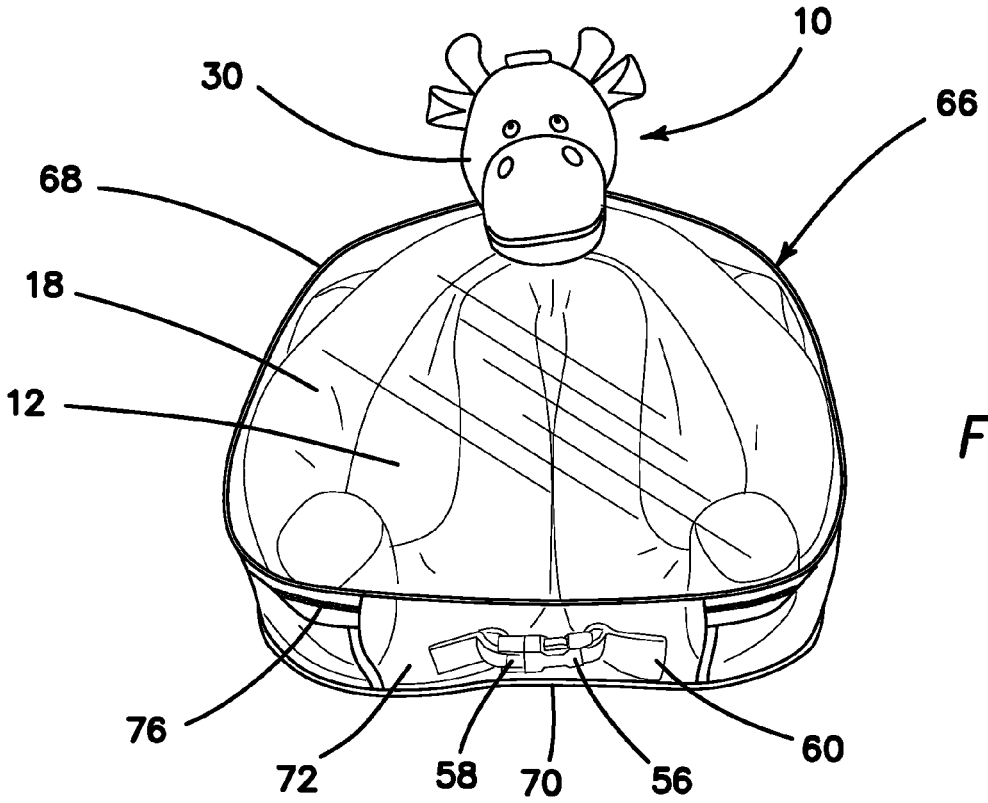
FIG. 5 is a top perspective view of a lounge in a closed configuration and located inside a transparent case according to the present invention.

The fastener 56 is configured to convert the lounge 10 between an open configuration and a closed configuration. The open configuration is shown in FIGS. 1-2 and the closed configuration is shown in FIGS. 3-5. The open configuration is characterized by base 12 being substantially flat and the sidewall 18 defining an elongated configuration. When in the open configuration, the lounge 10 is sized and configured to provide a lounging area for a child or pet within the inner space atop the cushioned base 12. The fastener 56 is unlocked when the lounge 10 is in an open configuration. When in the closed configuration, the first part 56 of the fastener 56 and the second part 60 are connected and locked. To unlock the fastener 56, flexible detents in the fastener 56 are depressed with fingers and the first part 58 is separated from the second part 60. To lock the fastener 56, one of the first and second part is inserted into the other of the first and second such that detents are inserted and ramped against the other part to snap into receiving apertures where they spring outwardly into to lock the fastener 56 as is known in a common buckle-type fastener 56. The locked configuration is suitable for portability and for transporting the lounge 10.

To convert the lounge 10 from an open configuration to a closed configuration, the first part 58 of the fastener 56 is moved into proximity with the second part 60 of the fastener 56 and connected together. Since the first and second parts 58, 60 are located on the outer surface 20 of the sidewall 18 and since the sidewall 18 and base 12 are flexible, moving the first and second parts 58, 60 of the fastener 56 closer to each other requires that the sidewall 18 and base 12 be deformed, buckled, or folded into a different configuration. In essence, converting to a closed configuration requires moving a portion of the sidewall 18 that is closer to the first part 58 of the fastener 56 to be closer to a portion of the sidewall 18 that is closer to the second part 60 of the fastener 56. As mentioned previously, the base 12 and sidewall 18 have a shape in the open configuration when viewed along the vertical axis 15 that is defined by the length being longer than the width. In the open configuration, the shape of the base 12 and sidewall 18 is oval or elongate. The oval or elliptical shape folds into a shape in a closed configuration that is depicted in U.S. Design patent application Ser. No. 29/503,524 in a more uniform manner than if the base 12 and sidewall 18 were egg-shaped or other-shaped. In the closed configuration, at least part of the sidewall 18 that is located between the two legs 50 below the longitudinal axis is folded to form a substantially inverted U-shape or curve when the lounge 10 is viewed from above along the vertical axis 15. The open part of the "U" is bridged by the fastener 56 and the closed curved part of the "U" is located near the head 30. To fasten the fastener 56, the sidewall 18 located between the legs 50 below the longitudinal axis 11 is curved inwardly toward the opposite sidewall 18 that is located above the longitudinal axis 11 as seen in FIGS. 3 and 5. The non-rigid base 12 folds along with the shape of the sidewall 18. The sidewall 18 when viewed along the vertical axis 15 forms two curved U-shaped lobes that are separated by a third curved U-shaped lobe that is inverted. Since the fastener parts 58, 60 are located between the legs 50, the closed configuration continues to mimic the animal or character because the head 30, arms 48 and legs 50 remain in anatomically correct locations with legs 50 and arms 48 extending outwardly from the body of the creature which is defined by the sidewall 18 and continues to define the body of the creature when in the closed configuration. The body of the creature which is the interior of the sidewall 18 is sized and configured for receiving a child or pet therein while in the open configuration. Hence, a child-receiving location is that part of the lounge that resembles the body or abdominal region of the creature. This construction provides the effect that the child is cradled by the creature feeling secure by seeing a face and arms and legs. The sidewall 18 in the open configuration creates a playful, comfortable and attractive space for the child to be placed or to climb into for play or relaxation. The plush toy formed by the head 30 may become the child's favorite toy allowing the child to feel comfortable going to sleep with the plush toy nearby and within sight. With the child's head propped up on the sidewall 18 in the location of the scallop 26 and with the scallop 26 ideally located along the longitudinal axis 11 that is perpendicular to the lateral axis 15 along which the head 30 is located, the child is able to enjoy a playful view of the head 30 of the character or creature watching over him or her as the head 30 extends upwardly from the sidewall 18 and its eyes face toward the center of the lounge 10 where the child is located. The child is able to access one or more of the pockets located in the head 30 by unzipping the mouth 36 or reaching into the ears 34 or nose 38 to retrieve toys and the like stowed therein. In one variation, one or more of the entertainment features 28 such one or more of the arms 48, legs 50, head 30, and tail 46 are sized and configured to flop or fold inwardly over the top end 24 of the sidewall 18 toward the interior space of the lounge 10 and rest against the sidewall 18 and serve as a pillow for supporting the head, leg or arm of the child resting inside the lounge 10 as well as serve as a toy inside the bed. Additional pockets with or without closure mechanisms may also be provided in any one or more of the limbs, arms, legs and tail for secreting small objects such as toys and the like. In one variation, when in the closed configuration, the lounge 10 when viewed from above along the vertical axis 15 has a maximum length along the longitudinal axis 11 that is equal to or shorter than the maximum width along the lateral axis 13. In the open configuration, the lounge 10 when viewed from above along the vertical axis 15 has a maximum length along the longitudinal axis 11 that is longer than the width along the lateral axis 13. Also, in the closed configuration, the top end 24 of the sidewall 18 remains substantially co-planar as in the open configuration or substantially defines a single plane that is substantially parallel to the base plane. Conversion between an open configuration and a closed configuration is substantially confined to movement of the lounge 10 along the lateral and longitudinal directions with buckling/folding of the base 12 taking place in vertical direction. Furthermore, the depth 64 of the lounge 10 as defined by the length of the sidewall 18 along the vertical axis 15 remains substantially the same in the open configuration as in the closed configuration. The flexible base 12 may buckle or fold into a direction of vertical axis 15 when in the closed configuration and the base 12 or bottom end of the sidewall 18 defines a plane that is substantially parallel to a plane defined by the top end of the sidewall in the closed configuration as well as in the open configuration.

When in a closed configuration, the lounge 10 further includes one or more carrying straps 62 to facilitate portability of the lounge 10. In one variation, the carrying straps 62 are configured as backpack straps. In particular, two carrying straps 62 are provided side-by-side and connected to the base 12 and/or sidewall 18. Each strap 62 has a first end connected at a location above the longitudinal axis 11 and a second end connected at a location below the longitudinal axis 11 in typical backpack fashion as shown in FIG. 4. The length of the carrying straps 62 are adjustable such that arms of the user can be passed through the loops formed by the carrying straps 62 so that the lounge 10 may be carried on the back of the user like a backpack. In one variation, the carrying straps 62 are attached to the bottom surface 16 of the base 12. An additional carrying strap 62 may be provided along the top of the sidewall 18 near the head 30 such that the lounge 10 may be easily grasped and carrying by one hand. The carrying straps 62 may be used to carry the lounge 10 while the lounge 10 is either in an open configuration or closed configuration.

Turning now to FIG. 5, there is shown a case 66 that is sized and configured to receive the lounge 10 while the lounge 10 is in the closed configuration. The case 66 includes a top panel 68 and a bottom panel 70 interconnected by a sidewall 72. In one variation, the top panel 68 is angled with respect to a horizontal bottom panel 70 to hold the lounge in a slightly upright orientation. The top panel 68 includes an inner surface and an outer surface. An opening 74 extends through the top panel 68. The opening 74 is located near the top of the case 66 and is sized and configured to permit the head 30 of the lounge 10 to pass through and remain disposed outside the case 66 while the rest of the lounge 10 is located inside the interior of the case 66. The opening 74 may be circular, rectangular, or square in shape. The top panel 68 is transparent and made of flexible plastic. The bottom panel 70 has an inner surface and an outer surface. The bottom panel 70 is made of transparent flexible plastic. The sidewall 72 is also transparent and has an inner surface and an outer surface. The top end of the sidewall 72 connects with the top panel 68 along its perimeter. The bottom end of the sidewall 72 connects with the bottom panel 70 along its perimeter. The top panel 68 is substantially planar and parallel to the substantially planar bottom panel 70. The sidewall 72 interconnects the top panel 68 and the bottom panel 70 to define an interior space for receiving the lounge 10. Alternatively, the case 66 is made of rigid or semi-rigid material such as cardboard and may or may not have transparent portions to view the lounge 10 inside the case 66. A zipper 76 is formed in the sidewall 72 near the top panel 68 that extends along at least a portion of the perimeter and is configured to be unzipped such that the top panel 68 can be lifted and the case 66 opened for inserting the lounge 10. The lounge 10 is inserted when in the closed configuration such that the fastener 56 is closed and the head 30 is aligned with the opening 74 in the top panel 74. The lounge 10 is dropped into the interior space of the case 66 and the top panel 68 is lowered such that the head 30 protrudes through the opening 74. The zipper 76 is then closed. In one variation, the zipper 76 is formed in the top panel 68 or anywhere along the case 66. In one variation, the bottom panel 70 includes elongate openings so that the carrying straps 62 may protrude through the case 66 permitting the case 66 and lounge 10 to be carried on the shoulders like a backpack. Additional carry straps may be provided on the case itself for easy handling and portability. The case 66 allows additional articles to be placed within the sidewall 18 of the lounge 10 when in the closed configuration and carried inside the case 66 and being contained by the zippered top panel without fear of them falling out. In one variation of the case 66, additional holes are formed so that the appendages of the lounge may also protrude from the case.

Figure 8:
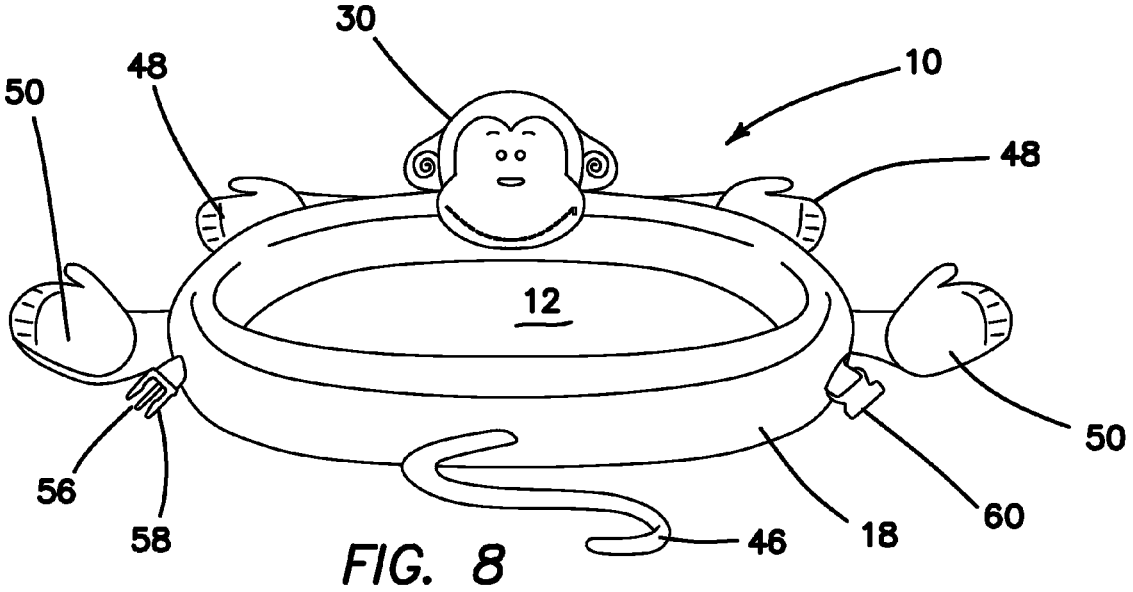
FIG. 8 is a top perspective view of a lounge according to the present invention.
Figure 9:
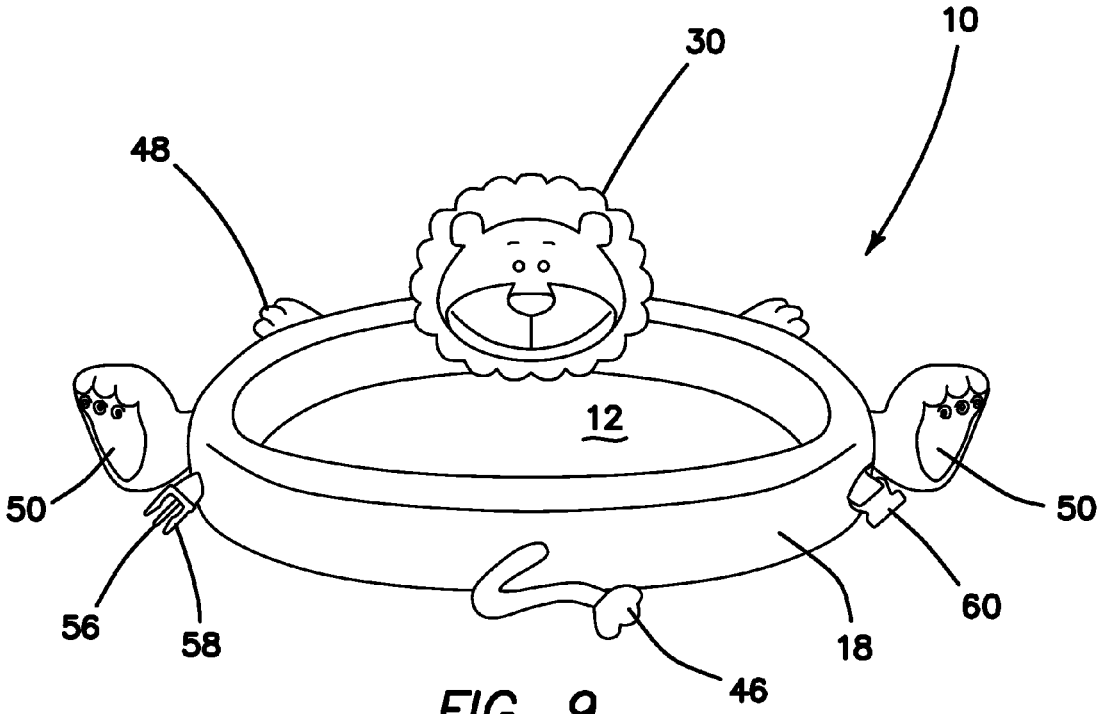
FIG. 9 is a top perspective view of a lounge according to the present invention.
Figure 10:
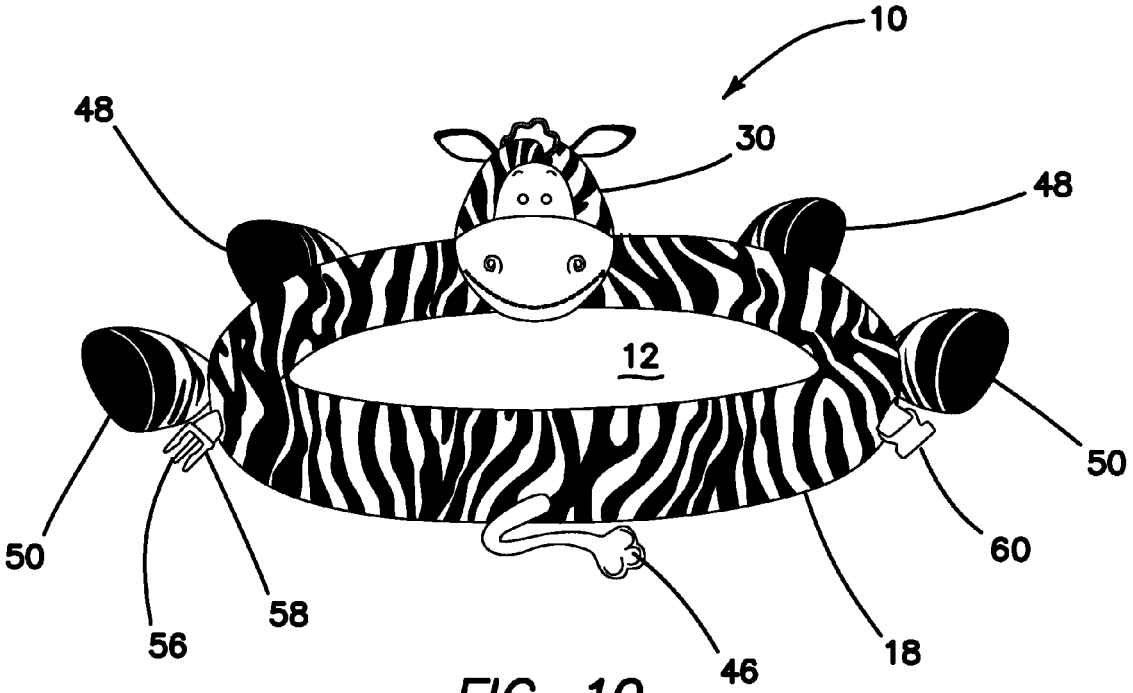
FIG. 10 is a top perspective view of a lounge according to the present invention.
Figure 11:
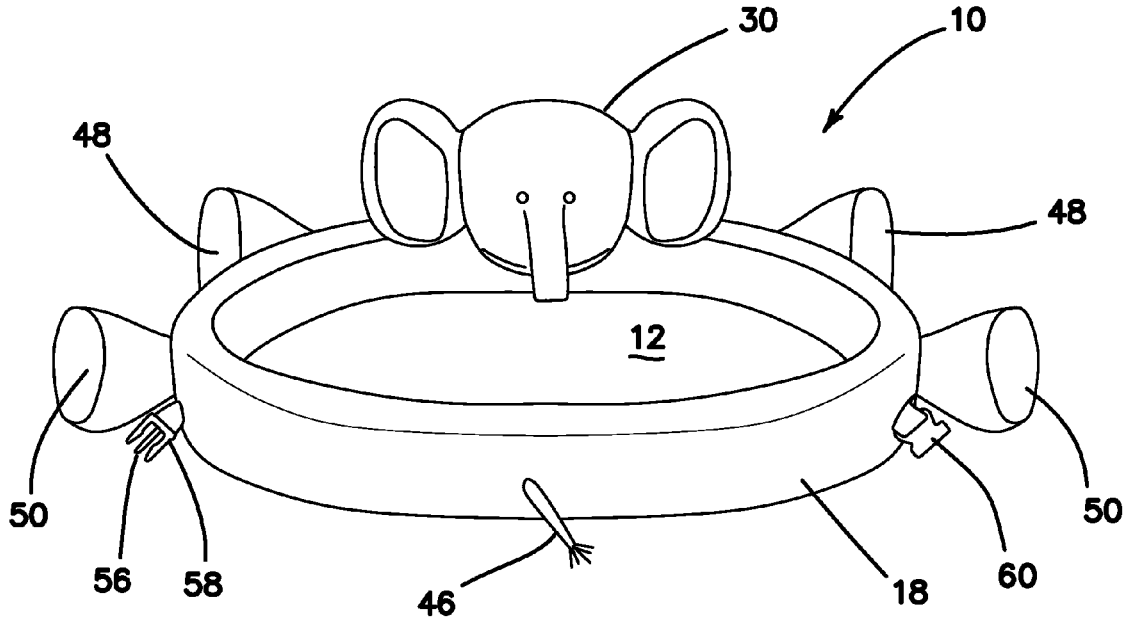
FIG. 11 is a top perspective view of a lounge according to the present invention.
Figure 12:
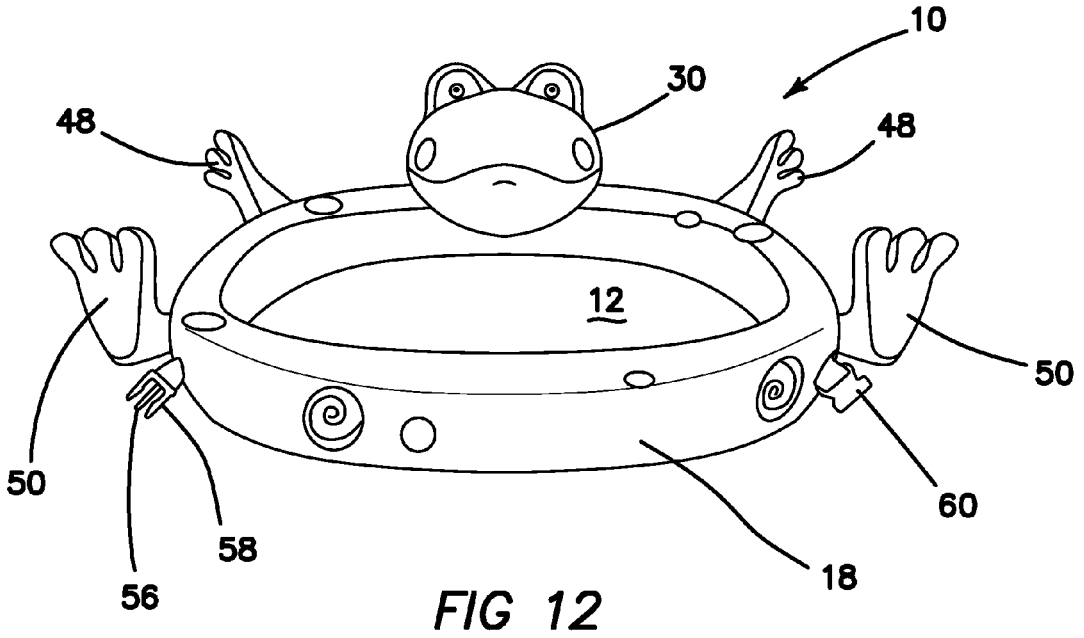
FIG. 12 is a top perspective view of a lounge according to the present invention.

Turning now to FIGS. 8-12, there is shown a number of variations of the lounge 10 wherein the entertainment features 28 of the lounge 10 comprise different stylized yet recognizable animals. For example, FIG. 8 illustrates a lounge 10 having the features of a monkey. FIG. 9 illustrates a lounge 10 having the features of lion. FIG. 10 illustrates a lounge 10 having the features of a zebra. FIG. 11 illustrates a lounge 10 having the features of a zebra and FIG. 12 illustrates a lounge 10 having the features of a frog. Of course, other animals such as a cat, tiger, hippopotamus as shown in FIGS. 1-7 or other real or whimsical, fantastic creature are within the scope of the present invention. The entertainment features 28 of the lounge 10 can be manufactured to physically represent anything that appeals to a child and includes but is not limited to a representation of any character from a movie, play, book, cartoon or other fictional or non-fictional source.

Figure 13:
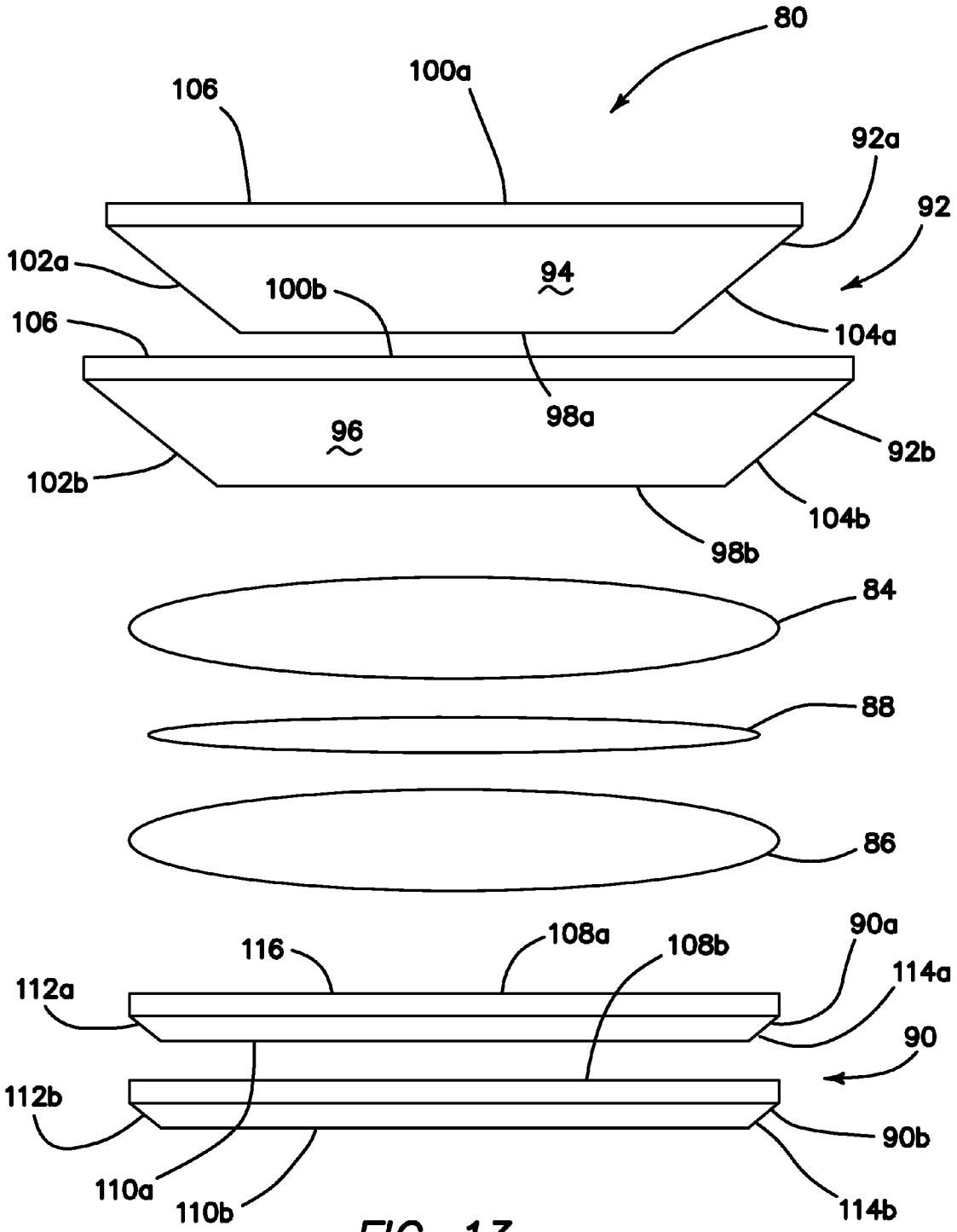
FIG. 13 is a fabric component layout of a cover of a lounge according to the present invention.
Figure 14:
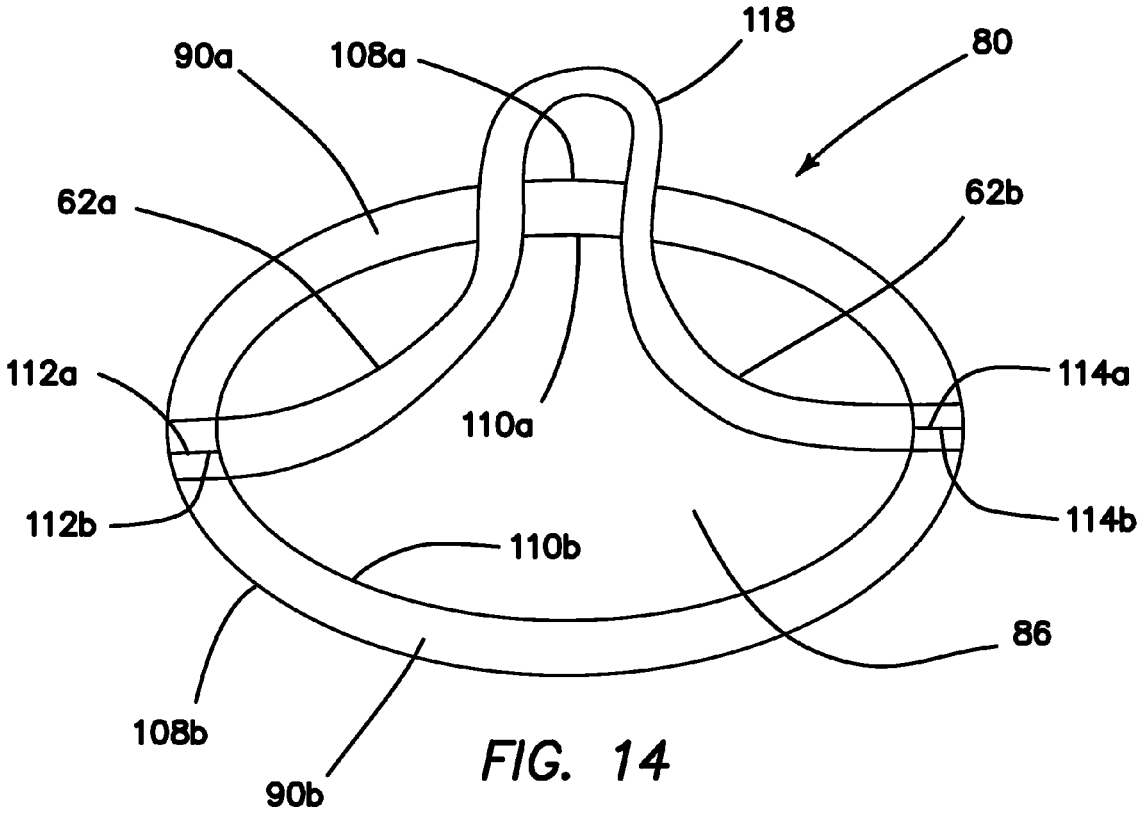
FIG. 14 is a bottom view of a cover of a lounge according to the present invention.
Figure 15:
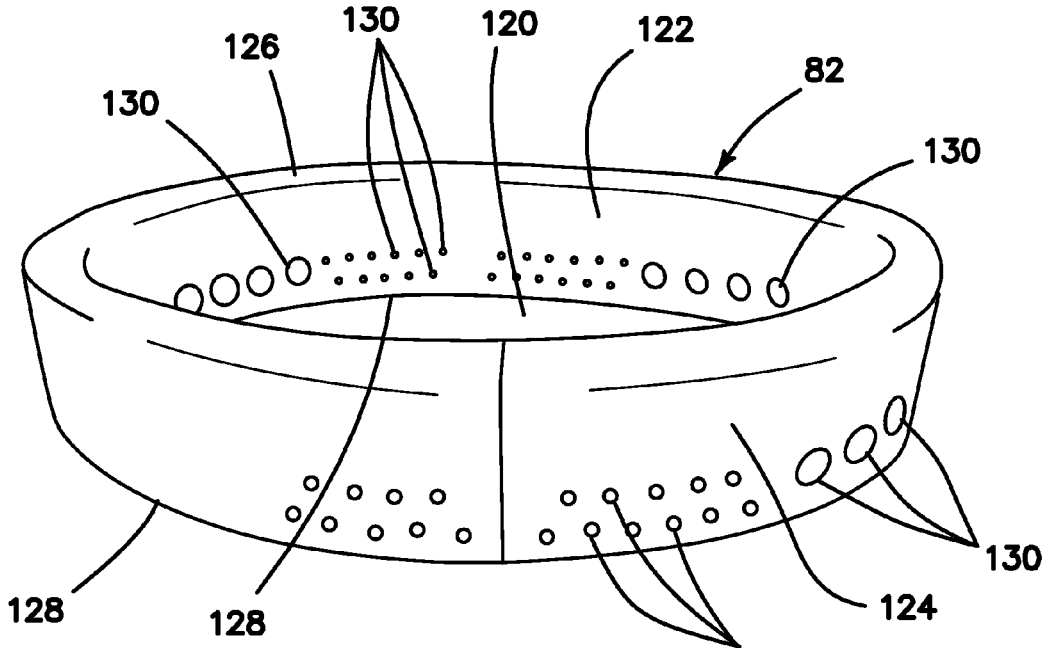
FIG. 15 is a top perspective view of an interior structure of a lounge according to the present invention.

Turning now to FIGS. 13-15, there is shown a lounge 10 according to the present invention. In one variation, the lounge 10 described above with respect to FIGS. 1-12 comprises a cover 80 and an interior structure 82. The interior structure 82 is configured to support the cover 80 and may comprise a wall-like structure. The cover 80 is made of soft fabric such as organic cotton and or mesh material and may comprise one or more of the various features described above such as one or more of the various entertainment features 28, a plush toy head 30, eyes 32, ears 34, mouth 36, nose 38, horns 40, hair 42, zipper 44, tail 46, arms 48, legs 50, limbs, carrying straps 62, fasteners, zippers and the like. The cover 80 is configured to encompass and surround an interior structure 82. In one variation, the cover 80 is removable, interchangeable and machine washable. One variation of a removable and interchangeable cover 80 is shown in FIGS. 13-14.

With particular reference to FIG. 13, the cover 80 includes a top panel 84 that is elongate or oval in shape, a bottom panel 86 that is also elongate or oval in shape and interior padding 88 that is also elongate or oval in shape. Although the invention is described with respect to an oval or elongate shape, the invention is not so limited and the panels 84, 86, 88 may be any shape that corresponds to the desired interior shape of the lounge 10 and/or shape of the interior structure 82. The interior padding 88 is sandwiched between the top panel 84 and the bottom panel 86. In particular, the top panel 84 includes an upper surface and a lower surface. The lower surface faces the interior padding 88 and the upper surface faces the interior of the lounge 10. The bottom panel 86 includes an outer surface and an inner surface. The inner surface faces the interior padding 88. The interior padding 88 is made of filler, fabric or other material to provide soft cushioning. The cover 80 includes a sidewall panel 92 that has an inner surface 94 and an outer surface 96. The sidewall panel 92 corresponds to the shape of the interior structure 82. In one variation the sidewall panel 92 is cylindrical in shape. In another variation, the sidewall panel 92 is made of a first part 92A and a second part 92B. The first part 92A includes an inner edge 98A and an outer edge 100A. The first part 92A also includes a left side edge 102A and a right side edge 104A. The second part 92B includes an inner edge 98B and an outer edge 100B. The first part 92B also includes a left side edge 102B and a right side edge 104A. If the sidewall panel 92 is made of two parts 92A and 92B they are sewn together to join the left side edges 102A, 102B and the right side edges 104A and 104B. A continuous zipper 106 is attached along the outer edge 100 of the sidewall panel 92. If two parts 92A and 92B are employed, the zipper 106 is connected along the outer edge 100A of the first part 92A and the outer edge 100B of the second part 92B. When sewn together or otherwise attached the first part 92A and the second part 92B form a substantially cylindrical sidewall panel 92. The left side edges 102A and 102B and right side edges 104A and 104B are angled with respect to the inner edges 98A, 98B and outer edges 100A and 100B to accommodate an elongate or oval interior structure 82 having a smaller inner perimeter relative to a larger outer perimeter.

Similar to the sidewall panel 92, the bottom wall panel 90 can be made of a single piece of cylindrical material or be made of two parts 90A and 90B that are joined together to create a cylindrical piece of material. The first part 90A and second part 90B have inner edges 100A and 100B, and outer edges 108A, 108B, left side edges 112A and 112B and right side edges 114A and 114B, respectively. If the bottom wall panel 90 is made of two parts 90A and 90B they are attached together such as by sewing the left side edges 112A, 112B together and the right side edges 114A, 114B together to create a cylindrical piece of material. As shown in FIG. 13, the left side edges 112A, 112B and the right side edges 114A, 114B are angled with respect to the inner edges 110A, 110B, respectively, and outer edges 108A, 108B, respectively to accommodate an oval or elongate interior structure 82 having a shorter inner perimeter relative to a longer outer perimeter. A zipper 116 is continuously attached (such as by sewing or other means such as heat sealing) to the outer edges 108A, 108B after the parts 90A, 90B have been connected. The zipper 116 is configured to zip together with the other zipper 106 in an easy manner making it easy to remove and wash the cover. The zippers 106, 116 define an opening in the cover 80 for accessing the interior space of the cover 80. The zippers 106, 116 function to close or open the opening to insert or remove the interior structure 82. Other fastening means instead of a zipper may be employed such as hook-and-loop type fasteners, buttons, snaps and the like known to a person skilled in the art.

The cover 80 is assembly by assembling the sidewall panel 92 and the bottom wall panel 90 and adding the zippers 106, 116. The inner edges 98A, 98B of the sidewall panel 92 as well as the inner edges 110A, 110B of the bottom wall panel 90 are connected (such as by sewing) to the perimeter of the top panel 84, bottom panel 86 and interior padding 88 to create the cover 80.

Turning now to FIG. 14, there is shown a bottom view of the cover 82. The cover 82 may be provided with additional carrying straps 62. Typically, two carrying straps 62 are provided for carrying the lounge 10 like a backpack. One end of a first carrying strap 62A is connected at the seam of left edges 112A, 112B to conceal the seam and a second strap 62B is connected at the seam of the right edges 114A, 114B to conceal the seam as shown in FIG. 14. The second ends of the first strap 62A and second strap 62B may be connected together with and at the intersection of the bottom wall panel 90 and bottom panel 86. A third or handle strap 118 may be connected in the same location of the second ends of the first and second straps 62A, 62B to minimize the number of seams to be created and make the cover easy to manufacture. The entertainment features 28 are not shown in FIGS. 13-15. However, the plush toy head 30, for example, may be connected to the midpoint along the first part 92A of the sidewall panel 92. Limbs such as arms 48 may be connected to the first part 92A of the sidewall panel 92. Legs 50 may be connected to the second part 92B of the sidewall panel 92 together with the first part 58 and second part 60 of the fastener 56.

Turning now to FIG. 15, there is shown an interior structure 82 of the lounger 10. The interior structure 82 is a foam wall that is removably insertable into the cover through the opening such that when the wall is concealed inside the cover and the opening is closable such as by a zipper to contain the foam wall in the interior space of the cover 82. The foam wall is cylindrical in shape having a central lumen 120. The interior structure 82 although described as a foam wall is not so limited and may have any shape or size or material that is soft yet resilient to pop open to and from a closed configuration while at the same time configured to support the cover 80. The lounge 10 pops open automatically in seconds by itself as the foam wall assumes its natural unbiased, unflexed configuration. The resilient foam material also makes collapsing the lounge 10 for portability easy and quick. In one variation, the interior structure 82 is a cylindrical foam wall made by joining together the free ends of a strip of foam. The wall includes an inner surface 122 and an outer surface 124 interconnected by a top 126 and a bottom 128. The inner surface 122 and the outer surface 124 define a wall thickness. In one variation, the wall includes a plurality of holes 130. The holes 130 are formed in the wall such that the holes 130 extend between the outer surface 124 and inner surface 122. In the variation shown in FIG. 15, the holes 130 are located near the bottom 128 and populate the bottom third or half of the wall. The wall may further include one or more scallops 26. In one variation, at least one scallop 26 is located along the longitudinal axis of the foam wall such that when a child lays lengthwise inside the interior of the lounge 10 the child's head is supported within the scallop 26. The scallops 26 are concave indentations that extend downwardly from the top 126 of the wall. The cover 80 is configured to conform to the shape of the scallops 26.

To insert the interior structure 82 into the foam wall 80, the zippers 106, 116 are disengaged from one another to expose the opening to the interior of the cover 80. The foam wall is then placed on a flat surface and the portion of the cover that comprises the sandwiched top panel 84, bottom panel 86 and interior padding 88 is dropped into the central lumen 120 of the foam wall with the rest of the cover draping over the wall. The zippered opening is sized and configured to receive the interior structure 82. The sidewall panel 92 extends from the sandwiched panels 84, 86 and 88 along the inner surface 122 of the foam wall. The sidewall panel 92 is pulled upwardly over the top 126 of the foam wall and downwardly along the outer surface 124 of the foam wall such that the zipper 106 meets the zipper 116 of the bottom wall panel 90. The bottom wall panel 90 is located adjacent to and runs along the bottom 128 of the bottom wall panel 90. The zippers 106, 116 are engaged and the zippered opening is closed to contain the foam wall inside the cover 80. When the sidewall panel 92 is draped over the top 126 of the foam wall, any entertainment features 28 become properly located. For example, the head 30 resides on or near the top 126 of the foam wall. The fastener 56 is located adjacent to the outer surface 124 of the foam wall.

Figure 16:
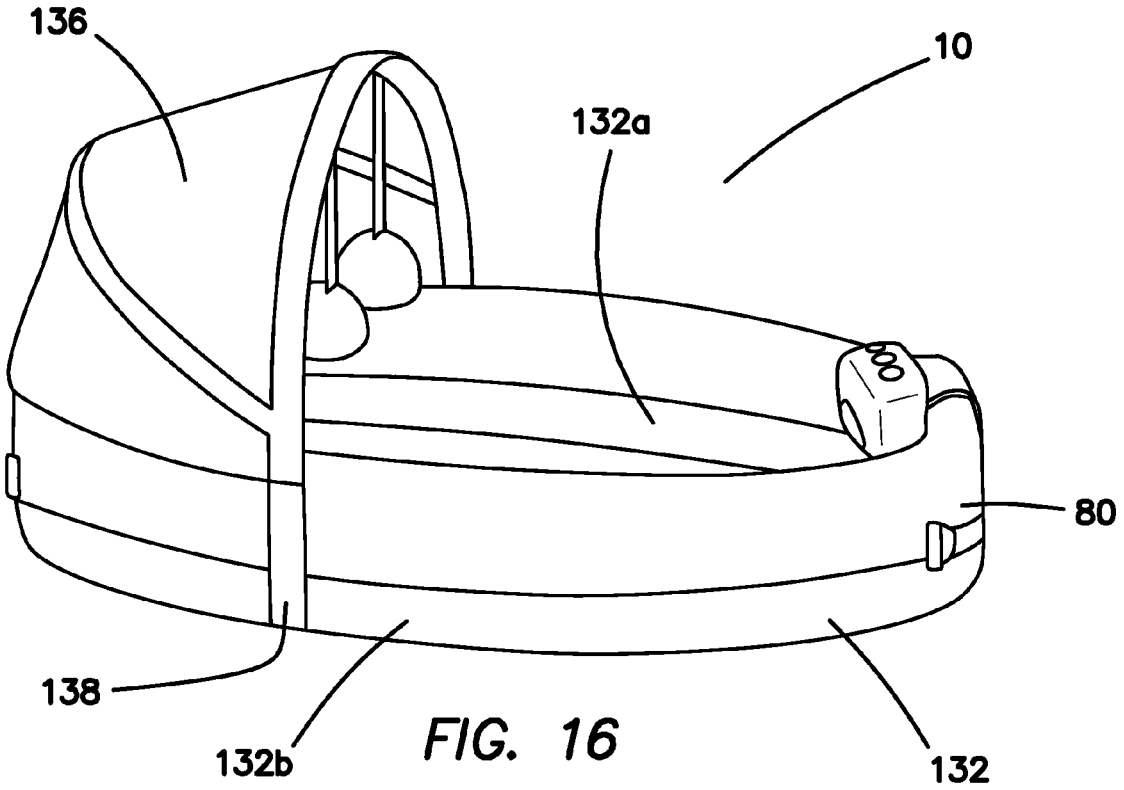
FIG. 16 is a top perspective view of a baby lounge with canopy according to the present invention.
Figure 17:
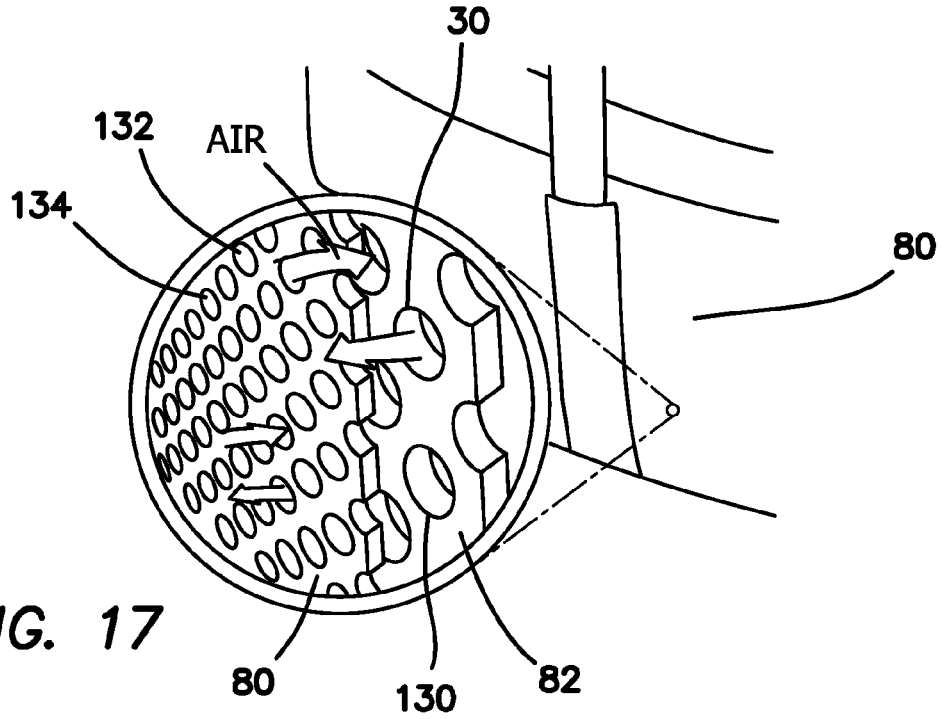
FIG. 17 is a top perspective, sectional view of a cover and wall of a ventilated lounge according to the present invention.

Turning now to FIG. 16, there is shown a lounge 10 according to the present invention. At least a portion 132 of the cover 80 includes holes (not shown) in the form of a mesh or the like. The mesh portion 132 that is ventilated is configured to be in communication with the holes 130 of the interior structure 82 such that air may flow from outside the lounge 10 to inside the lounge 10. As shown in FIG. 16, the sidewall panel 92 includes a first mesh portion 132A and a second mesh portion 132B such that when the foam wall is inserted into the cover 80, the first mesh portion 132A is located adjacent to the inner surface of 122 of the foam wall and the second mesh portion 132B is located adjacent to the outer surface 124 of the foam wall with both mesh portions 132A and 132B being located near the bottom 128 half or less of the height of the foam wall. The lounge 10 includes an interior supporting structure 82 that includes holes 130 that are in communication with holes 134 in the cover 80 with the holes 132 in the cover 80 being located on either side of the holes 130 in the interior structure 82 as shown in detail in FIG. 17. The mesh portions 132 in combination with the holes 130 of the interior structure 82 provide a unique air-flow system that advantageously helps reduce and prevent any suffocation hazard making the lounge safer for children.

Figure 19:
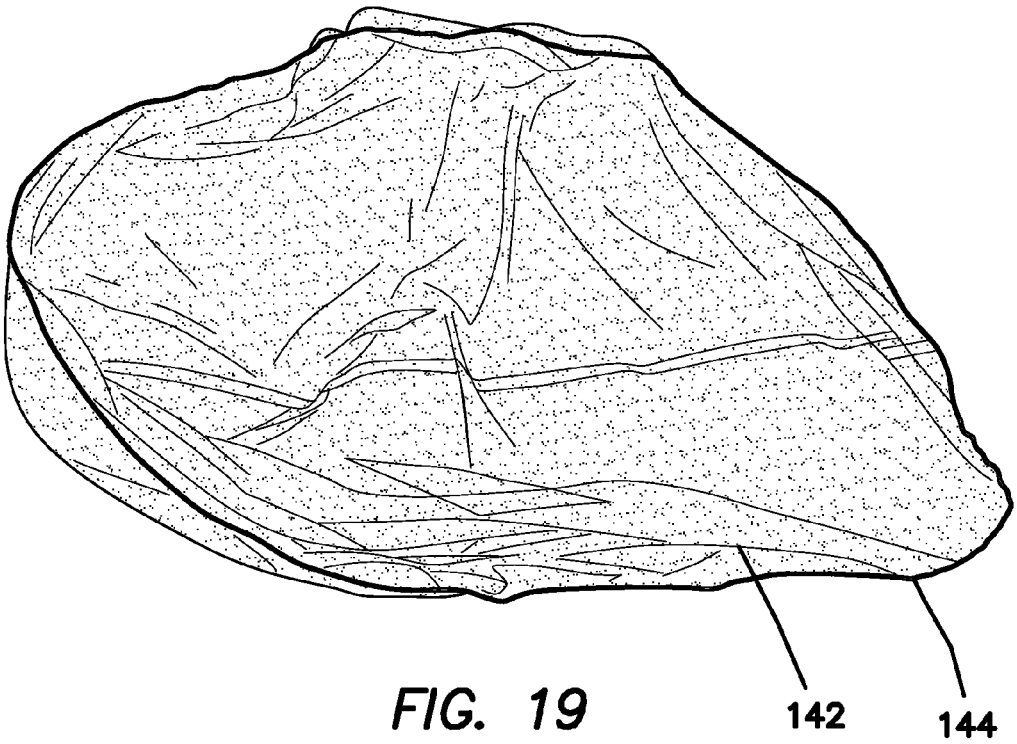
FIG. 19 is top view of protective netting according to the present invention.
Figure 18A:
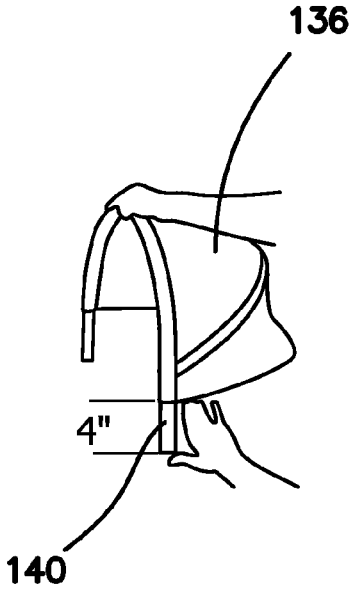
FIG. 18A is a top perspective view of a canopy and band according to the present invention.
Figure 18B:
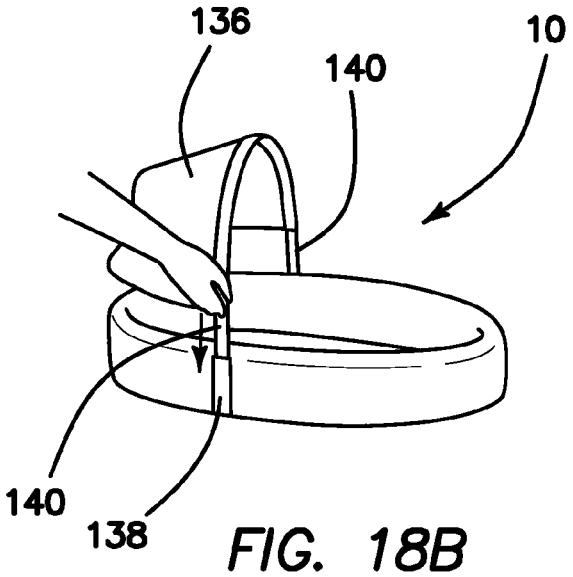
FIG. 18B is a top perspective view of a canopy being attached to the lounge according to the present invention.
Figure 20:
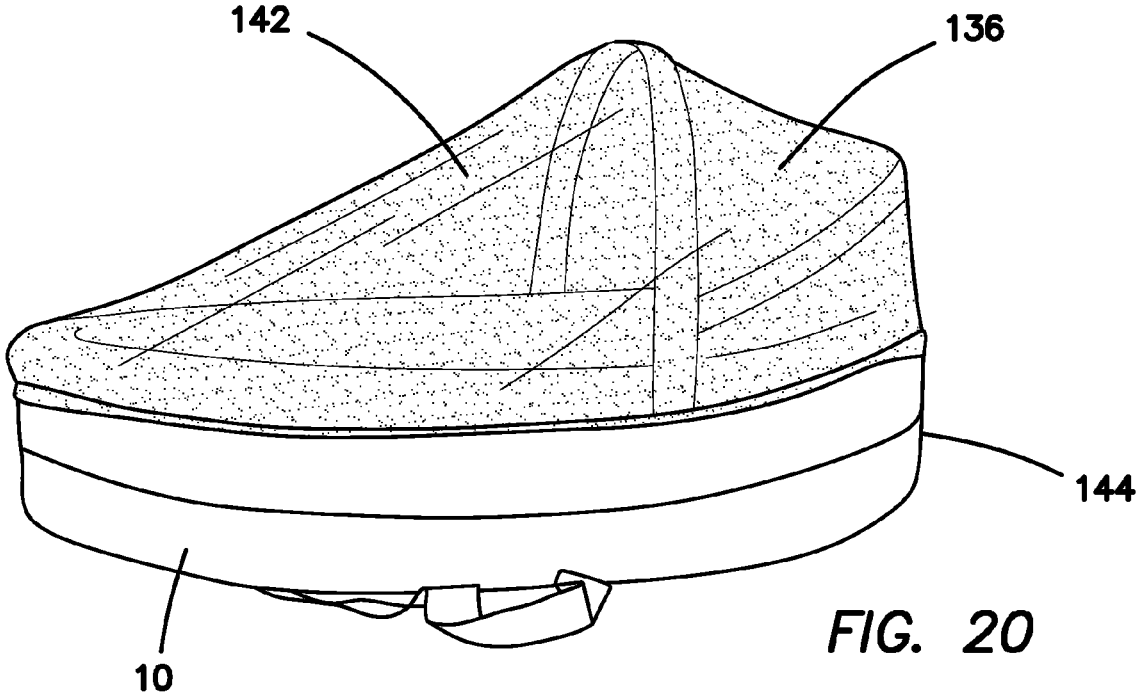
FIG. 20 is a top perspective view of a lounge with canopy and netting according to the present invention.
Figure 21:
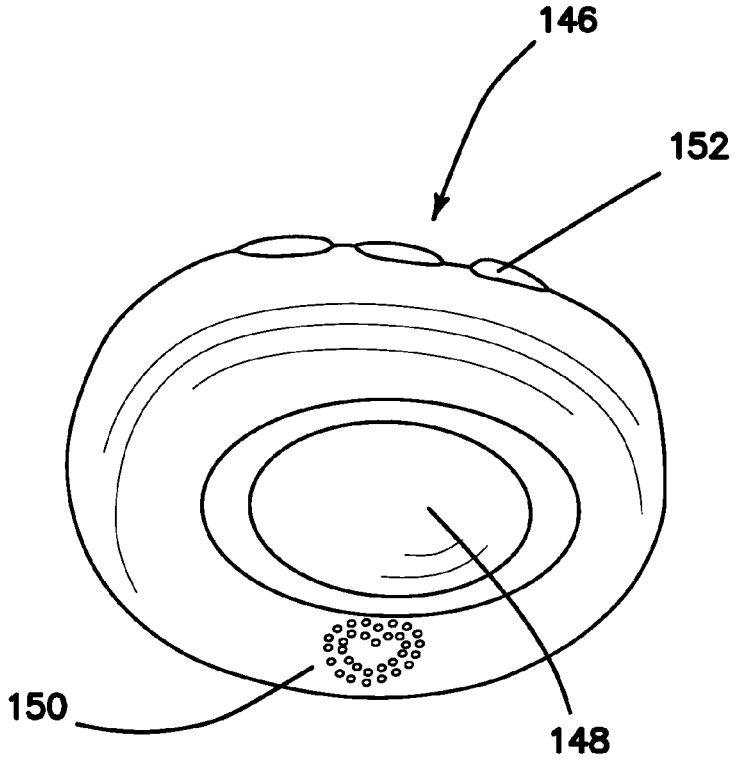
FIG. 21 is a front view of a soother according to the present invention.
Figure 22:
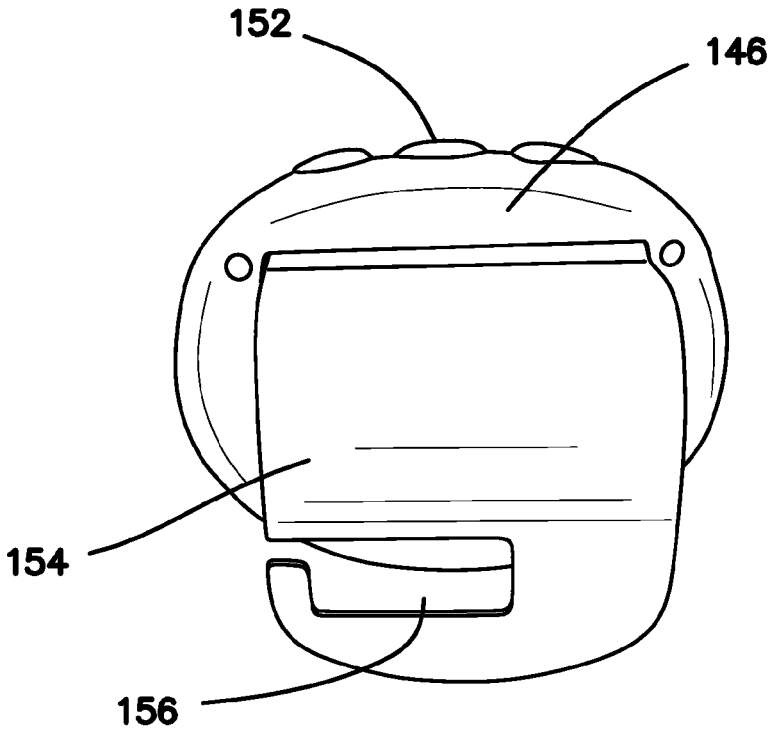
FIG. 22 is a back view of a soother according to the present invention.
Figure 23:
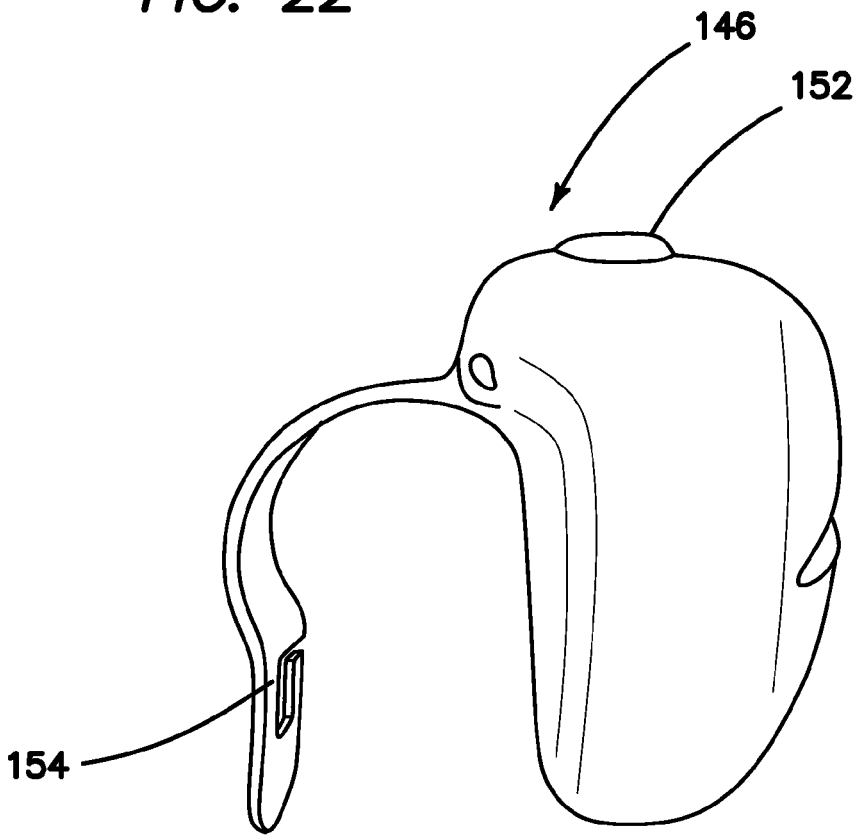
FIG. 23 is a side view of a soother according to the present invention.
Figure 24:
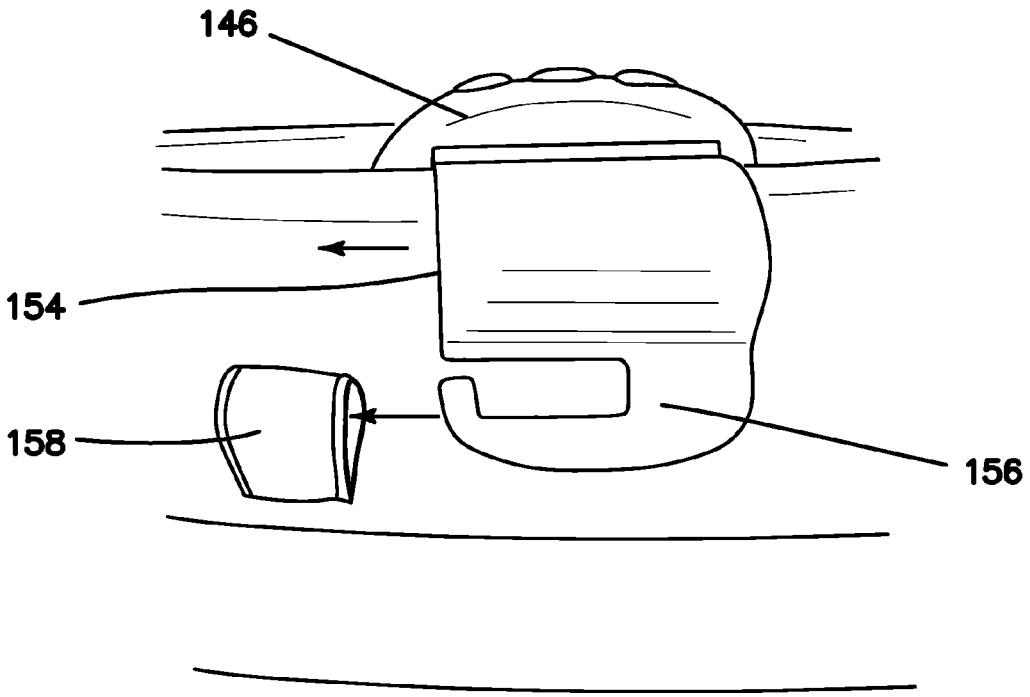
FIG. 24 is a top perspective view of a soother attached to a sidewall of a lounge according to the present invention.
Figure 25:
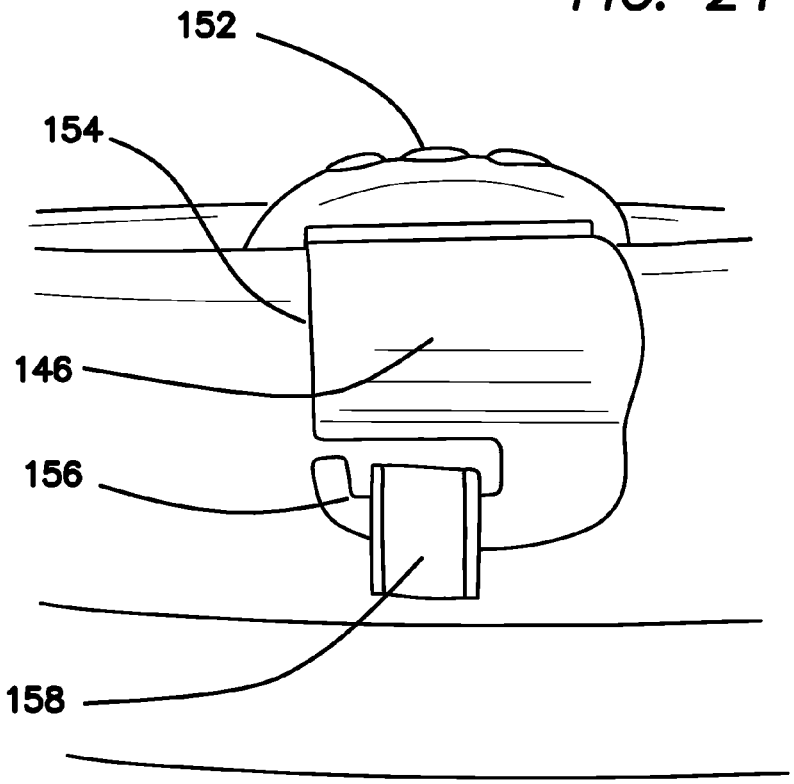
FIG. 25 is a top perspective view of a soother attached to a loop on a sidewall of a lounge according to the present invention.
Figure 26:
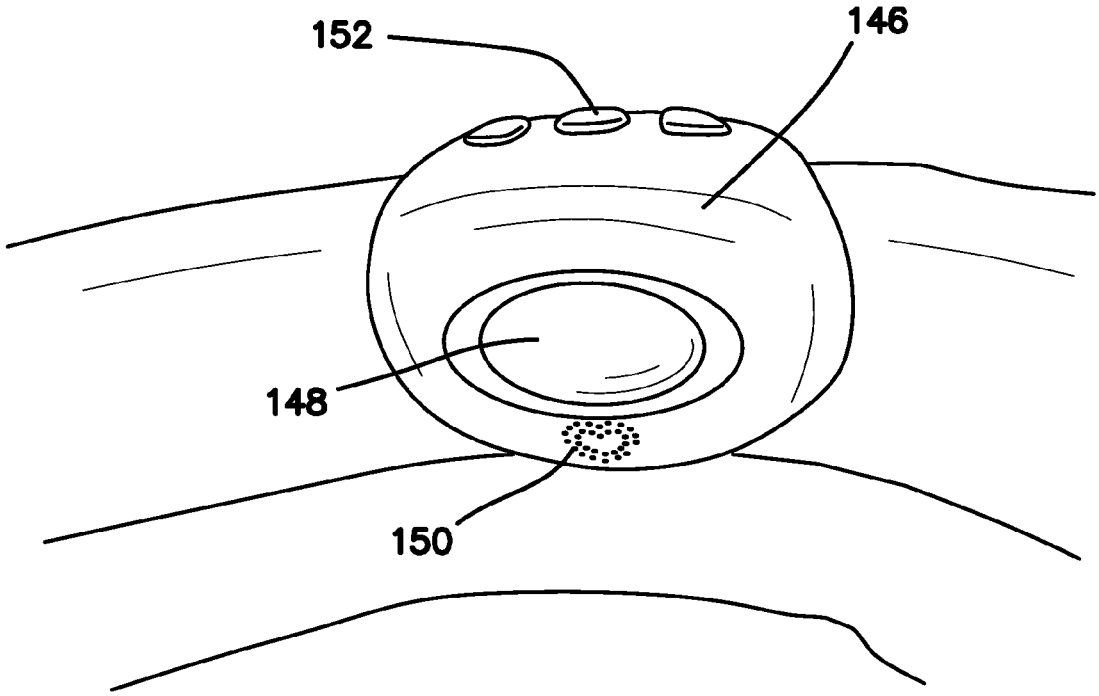
FIG. 26 is a top perspective view of a soother attached to a sidewall of a lounge according to the present invention.
Figure 27:
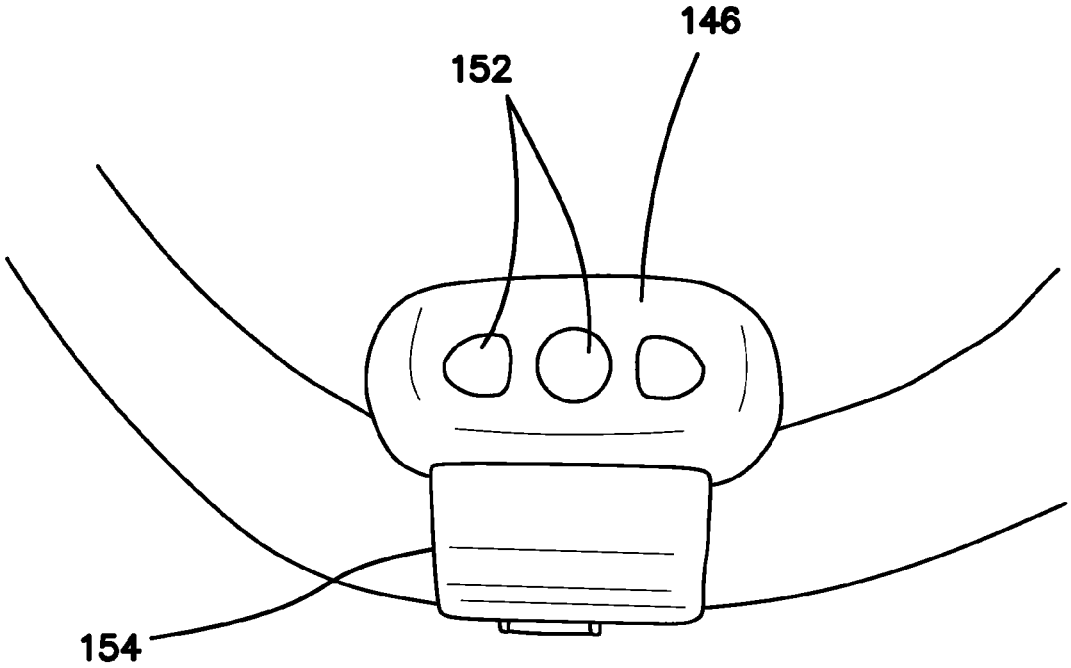
FIG. 27 is top view of a soother attached to a sidewall of a lounge according to the present invention.

As shown in FIG. 16, the lounge 10 may further include a detachable hood or canopy 136 that connects to the cover 80 as shown in greater detail in FIGS. 18A-18B. The cover 80 includes oppositely disposed pockets 138 for inserting the ends of a band 140 that supports the hood 136. The lounge 10 further includes a protective netting 142 as shown in FIGS. 19-20. The netting 142 is a piece of mesh material such as nylon with elastic perimeter 144. The elastic perimeter 144 stretches to expand and then is biased to be retained around the perimeter of the lounge 80 and hood 136 to protect the reclining baby from insects or other objects. The band 140 also serves as a toy bar that includes hooks for hanging toys in view of the lounger. The sidewall of the cover 80 may further include a sleeve for stowing the toy bar 140.

Figure 28:
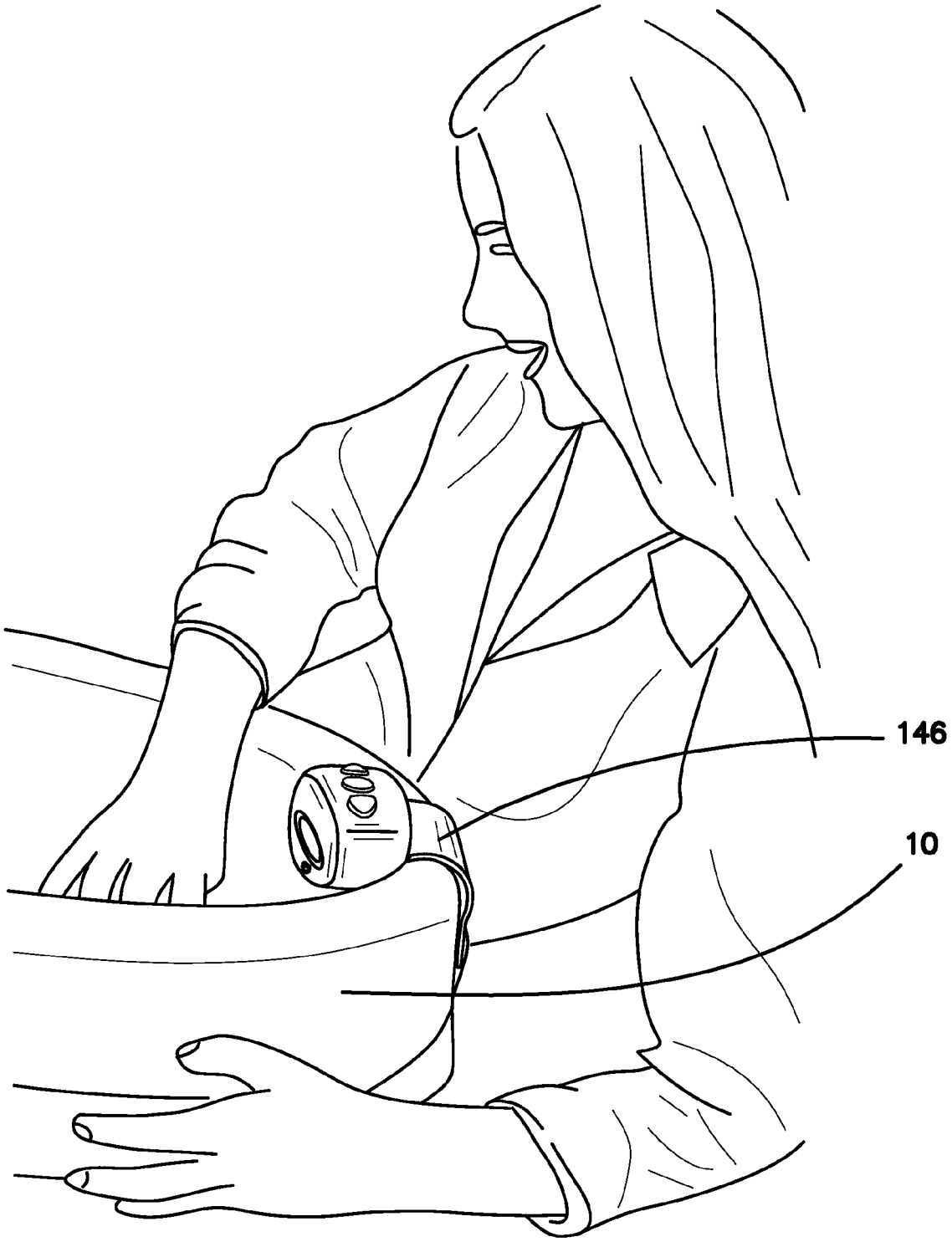
FIG. 28 is a top perspective view of a baby inside a lounge, with soother and parent according to the present invention.

Turning now to FIGS. 21-28, there is shown a soother 146 according to the present invention. The soother 146 is configured to connect with the lounge 10 to provide additional entertainment for the lounger. The soother 146 includes a device configured to transmit light, sound or vibration. As such, it includes a light 148 or light emitting diode that may be configured to cycle through a variety of different colors at a varying pace. The device may also include one or more speakers 150 to transmit sound, tunes, lullabies, music, soothing sounds of nature, water and the like. The device may also include a vibrating device to periodically vibrate to alert the lounger or enhance the sensory experience of the lounger. The soother 146 includes a plurality of control mechanisms 152 including an on/off switch and other buttons to activate the various features. The device has a first hook 154. The first hook 154 has a downwardly facing U-shape. The first hook 154 is configured to slide over a vertical sidewall of a baby lounge receiving the vertical sidewall inside the U-shape to secure the device onto the sidewall in the vertical direction. The soother 146 includes a second hook 156 located on the first hook 154. The second hook 156 comprising a cutout on a side of the first hook 154. The second hook 156 is configured to engage a loop 158 located on the vertical portion of the sidewall panel 92 of the cover 80 to secure the soother 146 in a lateral direction. The soother 146 is first placed such that that the U-shape of the first hook 154 is moved in a vertical direction and placed over the top 126 of the sidewall such that the sidewall of the lounge 10 is received inside the U-shape. Then, the soother 146 is moved in the lateral direction such that the second hook 156 is moved into the interior of the loop 158 on the cover 80 to connect the soother 146 to the lounge 10. The soother 146 provides additional entertaining and security features as shown in FIG. 28. A camera may also be included in the soother 146 such that a video of the lounger may be observed via the Internet or a BLUETOOTH device or smart phone. The lounge 10 is an ideal, comfortable and familiar environment for the child and it also makes it easy on the adult being light weight and portable eliminating the need for separately carrying a bassinet, crib, play pen, and activity mat. The lounge 10 of the present invention advantageously combines all of a bassinet, crib, play pen and activity mat into one item while providing various entertainment and comfort features for the child. There is no need to carry bulky items and the lounge of the present invention is easily convertible in seconds between an open position and a closed position for portability. The lounge is lightweight making it easy to carry when on the go.

It is understood that various modifications may be made to the embodiments of lounge 10 disclosed herein. Therefore, the above description should not be construed as limiting, but merely as exemplifications of preferred embodiments. Those skilled in the art will envision other modifications within the scope and spirit of the present disclosure.

I claim:

1. A lounge, comprising:

a base made of flexible material and having a top surface and a bottom surface defining a thickness therebetween; the base has a longitudinal axis and a lateral axis that is perpendicular to the longitudinal axis and a vertical axis that is perpendicular to a plane containing the longitudinal axis and the lateral axis; the base has a length along the longitudinal axis and a width along the lateral axis; the top surface and the bottom surface are substantially parallel to the plane containing the longitudinal axis and the lateral axis;

a sidewall connected to the base such that the sidewall encompasses the base to define an interior of the lounge; the sidewall extends from the top surface of the base upwardly along the vertical axis; the sidewall is made of flexible material and has a top end and a bottom end defining a height; the sidewall has an outer surface and an inner surface defining a thickness therebetween; the outer surface of the sidewall defines an outer perimeter; the sidewall being made of foam having a plurality of holes extending between the outer surface and the inner surface; at least a first limb and a second limb connected to the sidewall on a first side of the longitudinal axis; each of the first limb and second limb being substantially oppositely located from each other across the lateral axis; and a fastener connected to the outer surface of the sidewall; the fastener comprising a first part and second part; the first part being releasably connectable to the second part; the first part being connected to the second part when locked; the first part being disconnected from the second part when unlocked;

wherein the lounge includes an open configuration in which the fastener is unlocked and a closed configuration in which the fastener is locked;

wherein, when in the closed configuration, the sidewall defines a U-shape symmetric about the lateral axis when the lounge is viewed from above along the vertical axis and the fastener bridges an opening of the U-shape;

wherein the length of the base is longer than the width of the base; and wherein the first part and the second part of the fastener are located along the outer surface of the sidewall between the first limb and the second limb.

2. The lounge of claim 1 wherein when the fastener is locked, the at least first limb and the at least second limb stay outside of the locked fastener.

3. The lounge of claim 1 further including a head connected to the sidewall along the lateral axis and such that the head extends along the vertical axis a distance above the top end of the sidewall; the head having a face that faces the interior of the lounge.

4. The lounge of claim 1 wherein the fastener is oppositely located from the head along the lateral axis.

5. The lounge of claim 1 further including at least one strap configured such that the lounge can be carried as a backpack with the bottom surface of the base facing the users back.

6. The lounge of claim 1 wherein, when in the open configuration, the length of the lounge along the longitudinal axis is longer than the width of the lounge along the lateral axis and, when in the closed configuration, the length of the lounge along the longitudinal axis is shorter than the length of the lounge in the open configuration.

7. The lounge of claim 1 wherein when in the open configuration the length is x and when in the closed configuration, the length is reduced to x/2.

8. The lounge of claim 1 wherein when in the closed configuration, the length is reduced.

9. The lounge of claim 1 wherein the lounge is configured such that releasing the fastener from being locked to being unlocked results in the lounge automatically popping open from the closed configuration to the open configuration.

10. The lounge of claim 1 further including:

a cover having an opening;

wherein the foam sidewall is removably insertable into the cover through the opening such that the sidewall is concealed inside the cover and the opening is closable to contain the sidewall inside an interior of the cover;

wherein the foam sidewall is cylindrical in shape having a central lumen and the cover includes a padded base that extends across the central lumen; the foam sidewall and cover defining a container for an infant lounger.

11. The lounge of claim 10 wherein the cover includes a zipper to close the opening.

* * * * *